US005794818A

United States Patent [19]

Bromwell et al.

[11] Patent Number: 5,794,818

[45] Date of Patent: Aug. 18, 1998

[54] CONTAINER FOR BULK MATERIALS

[75] Inventors: Robert A. Bromwell, Rochester Hills, Mich.; Jack E. Harris, Savannah, Ga.; Alan M. Imboden, Marine City, Mich.; Karl L. Sommer, Lake Orion, Mich.; Thomas G. Witkowski, Shelby Township, Mich.

[73] Assignee: Romeo-Rim, Inc., Romeo, Mich.

[21] Appl. No.: 555,611

[22] Filed: Nov. 9, 1995

[51] Int. Cl.[6] ..... B65D 88/02

[52] U.S. Cl. ..... 222/105; 220/143; 220/185.1; 220/182; 220/108; 222/684; 222/693

[58] Field of Search ..... 222/105, 143, 222/185.1, 182, 108, 131, 608, 609; 220/4.21, 4.24, 684, 693, 328, 324, 605, 636, 606, 410, 411, 413, 601; 206/511, 512, 591, 523, 521

[56] References Cited

U.S. PATENT DOCUMENTS

| | | | |
|---|---|---|---|
| D. 216,590 | 2/1970 | Coleman | D23/2 |
| D. 298,450 | 11/1988 | Thomas et al. | D23/202 |
| D. 319,904 | 9/1991 | Cozzi et al. | D34/1 |
| D. 332,130 | 12/1992 | Przytulla | D23/202 |
| D. 337,367 | 7/1993 | McKenzie et al. | D23/202 |
| D. 349,944 | 8/1994 | Harris | D23/202 |
| D. 365,682 | 1/1996 | Calmeise et al. | D3/319 |
| 2,887,251 | 5/1959 | Mackridge | 222/131 |
| 3,072,285 | 1/1963 | Aileo | 220/44 |
| 3,244,311 | 4/1966 | Lawson | 220/4 |

(List continued on next page.)

FOREIGN PATENT DOCUMENTS

| | | | |
|---|---|---|---|
| 1333605 | 6/1963 | France | 222/185.1 |

OTHER PUBLICATIONS

21st Century Containers, Ltd.—Advertisement "Atlas 275 The Next Generation Liquid Tote", 4 pages (undated).

21st Century Containers, Ltd.—"Specifications for Atlas Returnable Container",5 pages (1992).

21st Century Containers, Ltd.—Advertisement "Atlas Intermediate Bulk Containers", 4 pages (1994).

Bonar Plastics Inc.—Advertisements "1140 Easy Clean Poly Combo Bin", 41 pages (undated).

Bonar Inc.—Advertisement "Payloader 275 SB", 4 pages (1993).

(List continued on next page.)

*Primary Examiner*—Andres Kashnikow
*Assistant Examiner*—Kenneth Bomberg
*Attorney, Agent, or Firm*—Renner, Kenner, Greive, Bobak, Taylor & Weber

[57] ABSTRACT

A container (10) includes an upper shell (11) and a lower shell (12) attached thereto by a connection mechanism (39). Corner columns (40,61) are formed between the walls (26,28,30; 46,63,64) of the shells (11,12), respectively. Spaced ribs (42,70) extend inwardly from the walls (26,28, 30; 46,63,64), respectively, to assist in supporting an internal container bottle (13). The bottle (13) has a valve assembly (59) which can be exposed through an opening (58) in the front wall (46). A valve access closure mechanism (60), including a door (143), is operable to close the opening (58). A lug (160) and notch (150) arrangement maintains the door (143) open, as desired. The bottom surface (74) of the container (10) is provided with a drainage system (76) having channels (78–81) all sloped toward a drain hole (82) so that any liquid in the container (10) is directed to the drain hole (82). Foot assemblies (14) include hollow, crushable foot members (118) of a predetermined profile. The foot members (118) are filled with a foam block (119) and have breakable tabs (104–108,110–112,114,115) which can be attached to the bottom surface (74). When a load is applied to the container (10), the tabs (104–108,110–112,114,115) will break and the foam will crush to absorb the energy and protect bottle (13). The top surface (15) of the container (10), while otherwise irregularly shaped, has flat ledges (21) near the corners thereof and of the same profile as the foot members (118) so that the container (10) can be stacked on a like container.

55 Claims, 23 Drawing Sheets

U.S. PATENT DOCUMENTS

| | | | |
|---|---|---|---|
| 3,261,505 | 7/1966 | Swenck | 222/83 |
| 3,343,719 | 9/1967 | Kastamo et al. | 222/1 |
| 3,448,897 | 6/1969 | Sterling | 222/105 |
| 3,729,121 | 4/1973 | Cannon | 222/185 |
| 3,782,602 | 1/1974 | Page | 222/143 |
| 3,785,534 | 1/1974 | Smith | 222/460 |
| 4,157,609 | 6/1979 | Schütz | 29/428 |
| 4,158,425 | 6/1979 | Sansbury | 220/461 |
| 4,173,288 | 11/1979 | Schutz | 220/1.5 |
| 4,231,482 | 11/1980 | Bogan | 220/4.21 X |
| 4,398,653 | 8/1983 | Daloisio | 222/185 |
| 4,426,015 | 1/1984 | Preston et al. | 220/403 |
| 4,485,924 | 12/1984 | Ripoll et al. | 222/143 X |
| 4,516,692 | 5/1985 | Croley | 222/105 |
| 4,746,034 | 5/1988 | Ata et al. | 222/143 |
| 4,793,519 | 12/1988 | Voorhies, Jr. | 220/465 |
| 4,930,661 | 6/1990 | Vorrhies | 220/465 |
| 4,949,872 | 8/1990 | Heaps, Jr. | 222/105 |
| 4,995,588 | 2/1991 | Nichols | 251/144 |
| 5,024,346 | 6/1991 | Roser | 220/401 |
| 5,029,734 | 7/1991 | Nichols | 222/105 |
| 5,064,096 | 11/1991 | Illing et al. | 222/105 |
| 5,105,947 | 4/1992 | Wise | 206/519 |
| 5,110,000 | 5/1992 | Nichols | 220/4.16 |
| 5,111,937 | 5/1992 | Schutz | 206/386 |
| 5,133,476 | 7/1992 | Schutz | 220/622 |
| 5,154,297 | 10/1992 | Farley | 206/599 |
| 5,156,268 | 10/1992 | Nichols | 206/386 |
| 5,163,587 | 11/1992 | Apps et al. | 222/105 |
| 5,201,432 | 4/1993 | Elvin-Jensen | 220/1.5 |
| 5,224,635 | 7/1993 | Wise | 222/608 |
| 5,232,120 | 8/1993 | Dunken et al. | 220/661 |
| 5,375,741 | 12/1994 | Harris | 222/105 |
| 5,445,289 | 8/1995 | Owen | 222/105 |
| 5,555,996 | 9/1996 | Lang-Ree et al. | 222/105 X |
| 5,564,599 | 10/1996 | Barber et al. | 222/105 |

OTHER PUBLICATIONS

Chemical Handling Equipment Co., Inc.—Advertisement "Introducing Tuff Tank. The safest, easiest, most cost effective way to handle hazardous liquids", 2 pages (1991).

Clawson Container Company—Advertisement "Longevity and Versatility", 4 pages (1995).

Clawson Container Company—Advertisement "Poly Jumbo Bin", 1 page (undated).

Custom Metal Craft—Advertisement "TranStore® Cleaning Systems", 2 pages (1993).

Custom Metal Craft—Advertisement "TranStore Transportable Storage Systems", 4 pages (1992).

Dan Plast—Advertisement "Défibox 400/800/1000", 4 pages (undated).

Fusion—Advertisement "Choisissez le leader: le Multibox Tout Plastique de Fusion.", 4 pages (undated).

Georgia Palmer—Advertisement "Atlas 360", 4 pages (undated).

Hoover Group, Inc.—Advertisement "and now . . . Bulk-drum® II",1 page (undated).

Hoover Group, Inc.—Advertisement "DuraTank®", 26 pages (1991 & 1992).

Mauser Containers—Advertisement "'Repaltainer' the New 1,000 Liter Composite IBC with Pallet 1000 × 1200 mm made of Recycled PE", 10 pages (undated).

Otto—Advertisement "CF en CFD", 2 pages (undated).

Pro-Tank—Advertisement "Les professionnels de la citerne", 4 pages (undated).

Schutz Container Systems, Inc.—Advertisement "Schutz Transport Container—Ecobulk System", 6 pages (undated).

Shuert Industries—Advertisement "The Uni-Pak Bulk System", 6 pages ( undated).

Snyder Industries, Inc.—Advertisement "Ship More Save More", 4 pages (undated).

Sonoco Products Company—Advertisement "Sonoco Sonobulk® 275", 4 pages (undated).

Sotralentz—Advertisement "SL5 U.N.", 2 pages (undated).

T & D Bison—Advertisement "Stacktank Container Range", 4 pages (undated).

Van Lerr—Advertisement "Concertainer® The cost-effective collapsible intermediate bulk container system",4 pages (1993).

Werit—Advertisement "We are talking about <<IBC>> more precisely WERIT IBC Predominant in Variety and Quality", 5 pages (undated).

Werit—Advertisement "Werit Container Innovationen in Verpackungen für Sicherheit und Umweltschutz", 8 pages (undated).

CONTAINER FOR BULK MATERIALS

TECHNICAL FIELD

This invention generally relates to a container of the type which is particularly suited to carry bulk liquid or solid materials. More particularly, this invention relates to such a container wherein a rigid plastic shell may safely hold a plastic bottle, bag or similar container therein which, in turn, holds the bulk material.

BACKGROUND ART

Traditionally, the transportation of extremely large quantities of bulk liquids or solids has been accomplished by tanker trucks or the like whereas smaller quantities thereof have been shipped or transported in the conventional 55-gallon drum. While such drums have for years been the benchmark for small quantity bulk material containers, such are not without their problems. Such is particularly the case where intermediate quantities of material, that is, more than 55-gallons and less than a tanker truck quantity, are desired to be stored and/or shipped.

In addition to their weight and the tendency to leak, dent, and corrode, one of the primary concerns regarding the 55-gallon drum relates to the costs of handling, using, and disposing of the same. For example, if in excess of 300 gallons of bulk material is desired, six 55-gallon drums must be separately filled, shipped, and then handled by the user. Dispensing of the material is not easy in that the container must be tipped and/or inverted to do so or a suitable pumping apparatus must be employed. Upon emptying, such drums must then be cleaned for re-use and often, upon opening a drum believed to be empty, the user finds a small quantity of remaining material therein which not only becomes wasted but which also compounds the cleaning problem and increases the attendant costs. Then the drums must usually be shipped for refilling, and since they take up as much space empty as filled, and since their cylindrical configuration wastes space when positioned side by side, return shipping costs are amplified. Finally, the life of such drums is such that disposal is required oftentimes after one use and certainly after no more than four uses. As such, unless the drums are cleaned, land fills will be loaded up with the remnants of possibly hazardous material, thereby incurring the potential for long-term, open-ended liability.

In an effort to solve at least some of these problems, recently some bulk containers have been introduced which have become known in the trade as intermediate bulk containers because they are capable of holding more material than a 55-gallon drum, but much less than a tanker truck. Typical of such containers are the types which include a plastic bottle-like tank which is received within a heavy metal cage or multi-walled corrugated box for structural support, carbon or stainless steel vessels, or containers having a high density polyethylene outer frame which supports a high density polyethylene bottle. While being capable of providing more volume than the 55-gallon drum, most of such containers are still heavy and difficult to clean and do not adequately protect the bottle in the event a container is dropped. Moreover, in most instances, there is no way for the user to be certain that the contents thereof have been completely depleted and as in the case of the 55-gallon drum, quite often when the container is opened, some remaining material is found therein. In addition, most of these containers are quite expensive and are not designed for easy access, disassembly, easy cleaning, and hence long-term reuse.

The metallic prior art versions can easily become corroded due to paint chips and aggressive environments, thereby engendering high reconditioning and/or replacement costs. On the other hand, the plastic prior art versions tend to bulge under full conditions, giving at least the appearance of weakness. Finally, all of such containers are quite heavy when in the empty condition and cannot be readily stacked when in the full condition, thus making their shipment, either full or empty (for refilling) a costly procedure.

DISCLOSURE OF THE INVENTION

It is thus an object of the present invention to provide a light-weight, lower cost, reusable bulk container of an intermediate size, being capable of holding a quantity of material of several 55-gallon drums.

It is another object of the present invention to provide a container, as above, in which a plastic shell can hold a plastic bottle, bag or the like which holds the bulk material.

It is a further object of the present invention to provide a container, as above, in which the bottle is safely held even if the container is dropped.

It is an additional object of the present invention to provide a container, as above, which utilizes rib structures for strength as well as to confine the bottle, while at the same time allowing for bottle expansion between the ribs during dropping or high temperature conditions.

It is yet another object of the present invention to provide a container, as above, in which the housing is of a modular or split design for ease of manufacture and versatility, and yet the split frames can be readily attached together by a mechanism which also adds hoop strength to the container.

It is a still further object of the present invention to provide a container, as above, in which the housing provides access to a drain valve at the bottom of the bottle and yet the valve is protected from damage.

It is another object of the present invention to provide a container, as above, which has corner columns and energy-absorbing, systematically crushable feet to absorb the energy of a drop or fall.

It is a further object of the present invention to provide a container, as above, in which the housing has a drainage passage should the bottle overflow or leak a fluid that it might be carrying.

It is an additional object of the present invention to provide a container, as above, which can be stacked, up to at least three high, even when filled with a bulk material.

It is still another object of the present invention to provide a container, as above, which is easy to clean, able to withstand high temperatures, and can resist most aggressive chemical compositions.

These and other objects of the present invention, as well as the advantages thereof over existing prior art forms, which will become apparent from the description to follow, are accomplished by the improvements hereinafter described and claimed.

In general, a container made in accordance with the concepts of the present invention has several unique features. In accordance with one aspect of the present invention, the container includes a bottom surface and walls extending upwardly therefrom. A plurality of foot assemblies support the bottom surface, each foot assembly including a hollow foot having a plurality of breakable tab members extending upwardly therefrom. A crushable foam block is positioned in the hollow foot and selected of the tab members are connected to the bottom surface so that when a load is applied to the container, the tab members will break and the foam will crush to absorb the energy of the load and protect the contents of the container.

Those contents can include a flexible internal bottle to hold a liquid material. The bottle includes a valve assembly, access to which is gained through an opening in one of the walls. A door may be provided to selectively open and close the openings, and means are provided to hold the door in an open position.

In accordance with another aspect of the present invention, a top surface connects the top of the walls and corner columns extend from the top to the bottom of the container between each of the walls to provide extraordinary structural strength to the container.

Strength is also provided to the container by rib structures provided throughout. For example, spaced ribs extend inwardly from the walls not only to provide strength, but also to support the flexible bottle. The bottle is also thereby able to expand into spaces between the ribs should it be overfilled or expand due to high temperatures or a shock to the container.

The bottom surface of the container may be provided with a plurality of drainage channels formed on the inside thereof. All of the channels are sloped toward a drain hole so that any liquid in the container may pass through the drain hole, as desired.

The top surface of the container, while otherwise irregularly shaped, may be provided with flat ledges of a predetermined profile formed at the corners thereof. The foot members of the container are of the same profile so that the container can be readily stacked on a like container.

Finally, in accordance with another important aspect of the invention, the container may be made in two parts. That is, it includes a first section having the top surface, downwardly directed walls and an open bottom, and a section having the bottom surface, upwardly directed walls, and an open top. The walls of the first section mate with the walls of the second section and a connection mechanism is provided to attach the walls of the first and second sections.

A preferred exemplary container for bulk materials incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
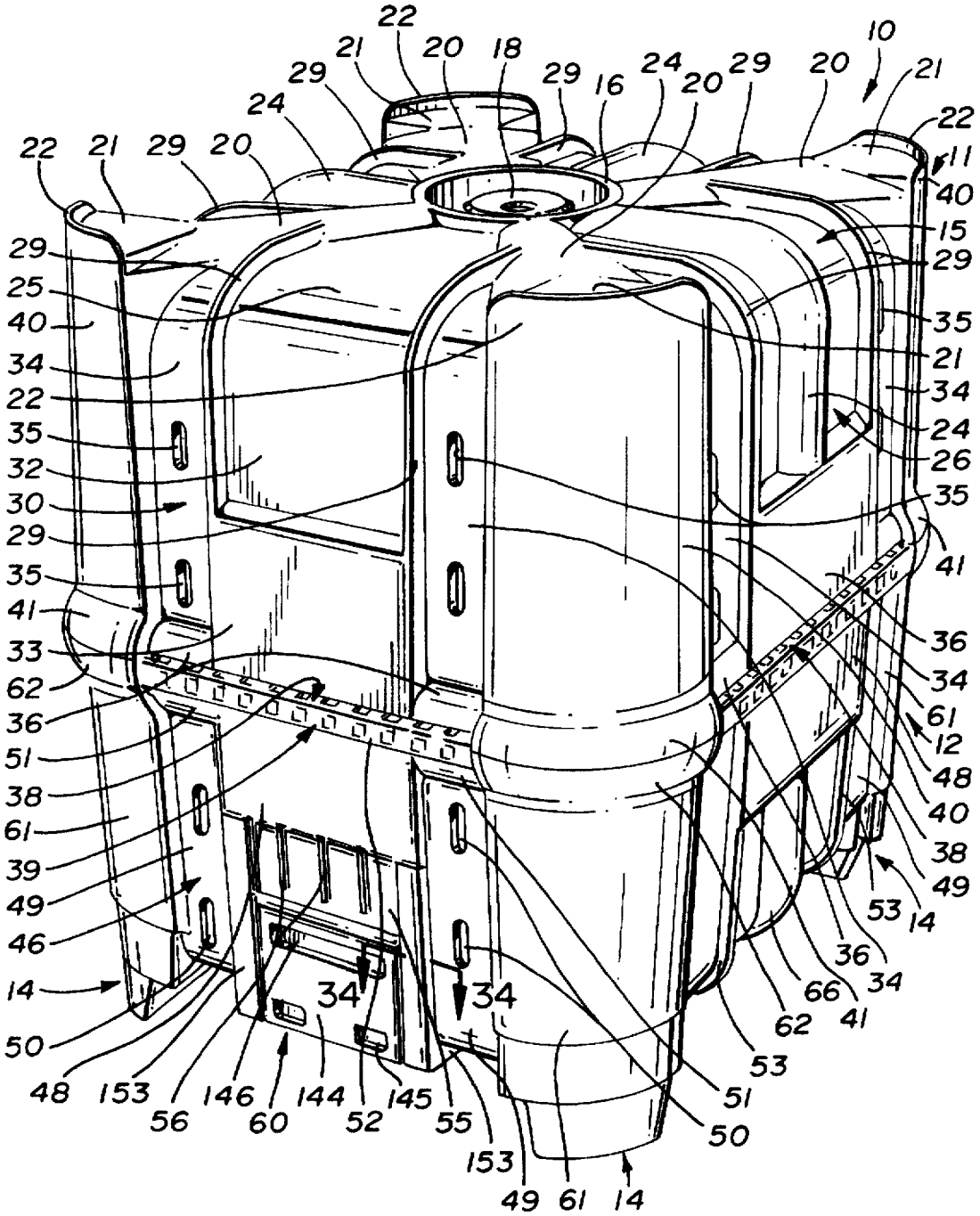
FIG. 1 is a perspective view of a container for bulk materials made in accordance with the concepts of the present invention.
Figure 2:
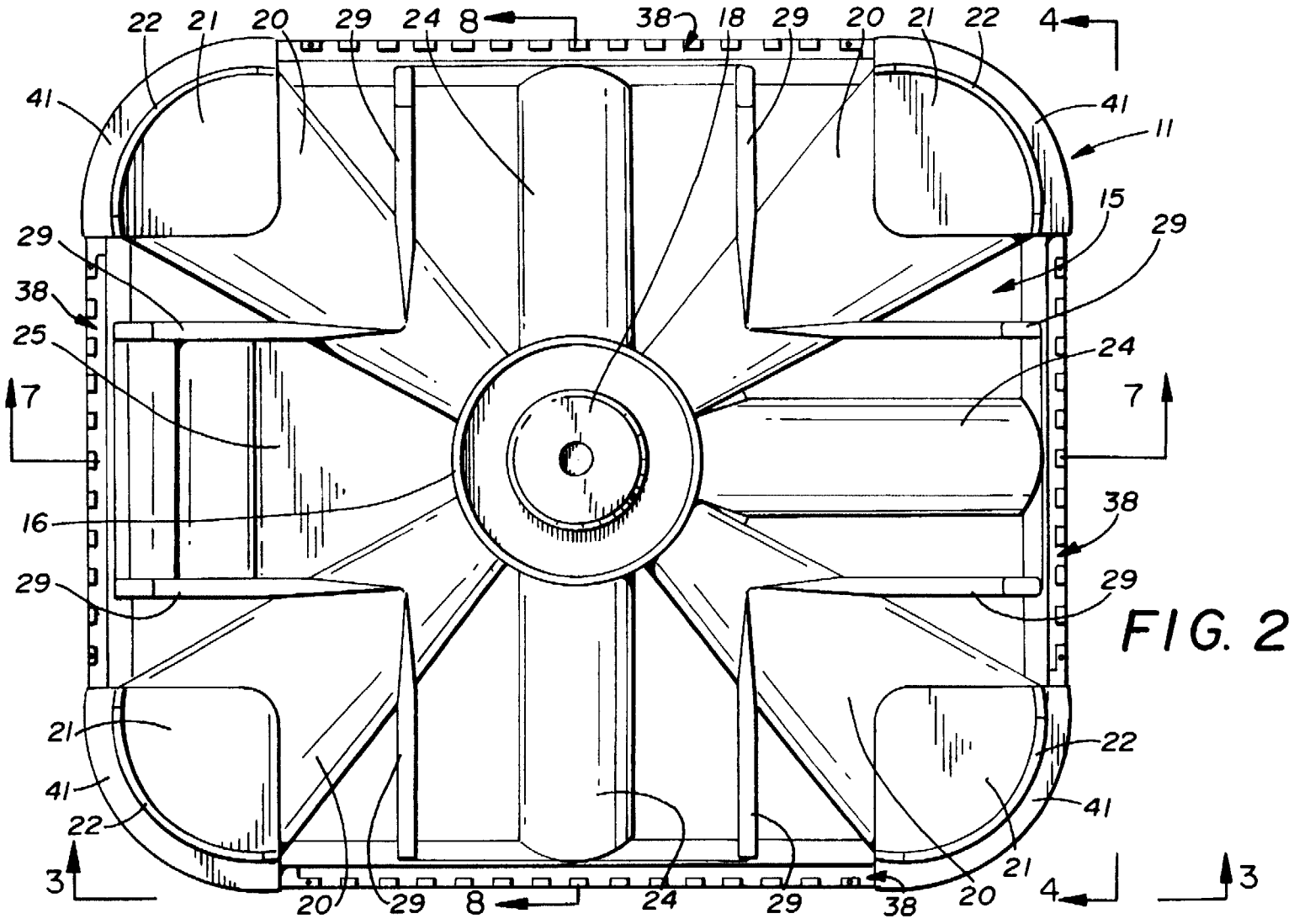
FIG. 2 is a top plan view of the container of FIG. 1.

A container for bulk materials is indicated generally by the numeral 10 in FIG. 1 and it preferably includes an upper shell or section generally indicated by the numeral 11, a lower shell or section generally indicated by the numeral 12, an internal container bottle carried within sections 11 and 12 and generally indicated by the numeral 13, and foot assemblies generally indicated by the numeral 14. The two sections 11 and 12 are preferably made of a reaction injectable plastic material. The utilization of two sections not only assists in the manufacturing process, but also allows container 10 to be made larger as by positioning a spacer between upper section 11 and lower section 12. As will hereinafter be described with specific reference to FIGS. 19–22, sections 11 and 12 are attached to each other to form an integral housing for bottle 13. Bottle 13 or an equivalent bag may be employed when container 10 is utilized to carry a liquid material. If used to hold dry materials, bottle 13 may not be necessary and could, if desired, be replaced by a bag or, alternatively, container 10, with some modifications, could directly carry the dry materials.

But first describing upper shell or section 11 with specific reference to FIGS. 1–8, it is open at the bottom and includes a top, external, irregularly configured surface, generally indicated by the numeral 15, having a central circular hub 16 which surrounds and gives access to a twist off cap 18 of bottle 13. A plurality of structural ribs 19 (FIG. 5) radiate generally diagonally outwardly from hub 16 and are tied together by upper arcuate surfaces 20. Flat ledges 21 are formed at the ends of ribs 19 at the four corners of top surface 15 which, as will hereinafter be described, are adapted to receive the feet 14 of an appropriately configured or like container for stacking purposes. To that end, arcuate lips 22 extend upwardly from top surface 15 at the lateral edge of ledges 21 so as to laterally confine and assist in the positioning of the feet 14 of a like container when stacked on container 10.

Top surface 15 also includes structural ribs 23 (FIG. 5) radiating toward the rear and sides of container 10 which are tied together by upper arcuate surfaces 24. While similar ribs 23 radiate partially toward the front of container 10, preferably they are not tied together so as to form a flat surface 25 at that area so that the container may receive a company logo or other identifying indicia or information if desired. To provide further strength to container 10 and to allow spaces for expansion of bottle 13, ribs 23 and surfaces 24 extend downward from the top 15 partially along container sidewalls generally indicated by the numeral 26 and container back wall generally indicated by the numeral 28. Top surface 15 is also provided with eight upwardly projecting ribs 29 which begin generally midway along arcuate surfaces 20 and extend outwardly to sidewalls 26 and back wall 28, as well as toward container front wall generally indicated by the numeral 30. Ribs 29 also continue downwardly on sidewalls 26, back wall 28 and front wall 30 and extend generally all the way to the bottom of upper container section 11. As will be hereinafter described in more detail, ribs 29 are open to the inside of top surface 15, thereby defining channels 31 (FIG. 5) which assist in the drainage of any liquid which might be in container 10.

With reference to FIG. 1, it can be seen that front wall 30 of upper section 11 includes a generally flat recessed surface 32 which is a continuation of top flat surface 25 and which merges with a flat raised surface 33 positioned below surface 32. To the sides of surfaces 32 and 33, and separated therefrom by ribs 29, are recessed surfaces 34 which have staggered sightholes 35 formed therein so that one can view the contents of bottle 13 which is preferably made of a translucent blow molded high density polyethylene material but which, of course, may be made by any equivalent process and of any equivalent material. The bottom of each recessed surface 34 is provided with an arcuate lip 36 which together with the bottom of surface 33 carry a castellated surface, generally indicated by the numeral 38, which forms part of the connection mechanism shown in detail in FIGS. 19–22 and indicated generally by the numeral 39 to be hereinafter described in detail. On each side of recessed surfaces 34, corner columnar legs 40 are formed extending downwardly from lips 22. Legs 40 terminate at their lower end as an arcuate skirt 41 which extend outwardly and thereby serve to protect connection mechanism 39 from damage as containers 10 may be moved about adjacent to walls or the like.

Figure 3:
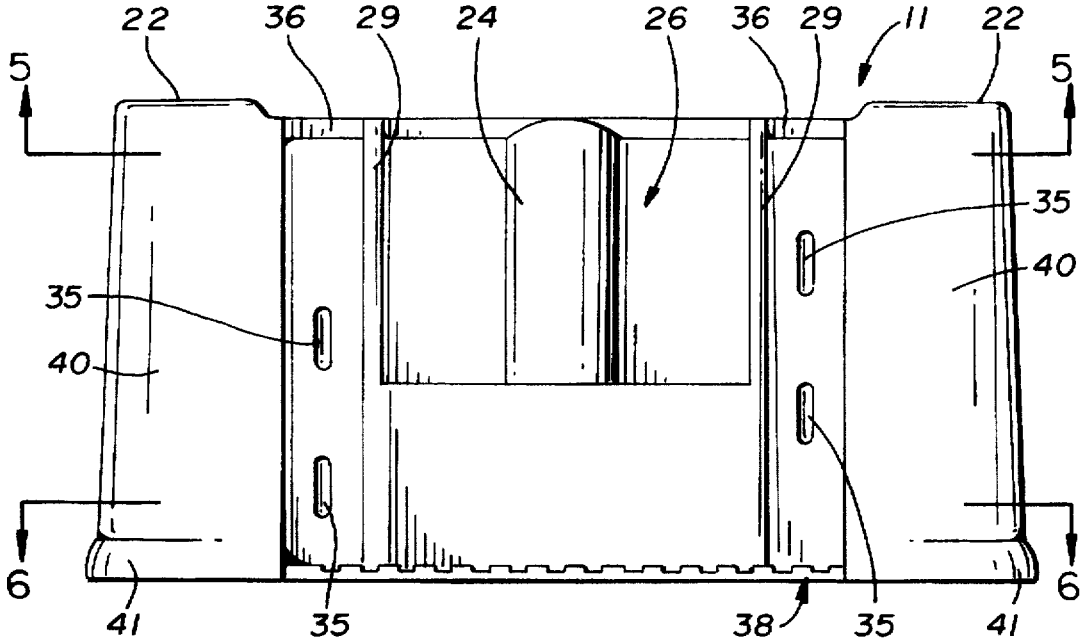
FIG. 3 is a side elevational view of the upper section of the container taken substantially along line 3—3 of FIG. 2.
Figure 4:
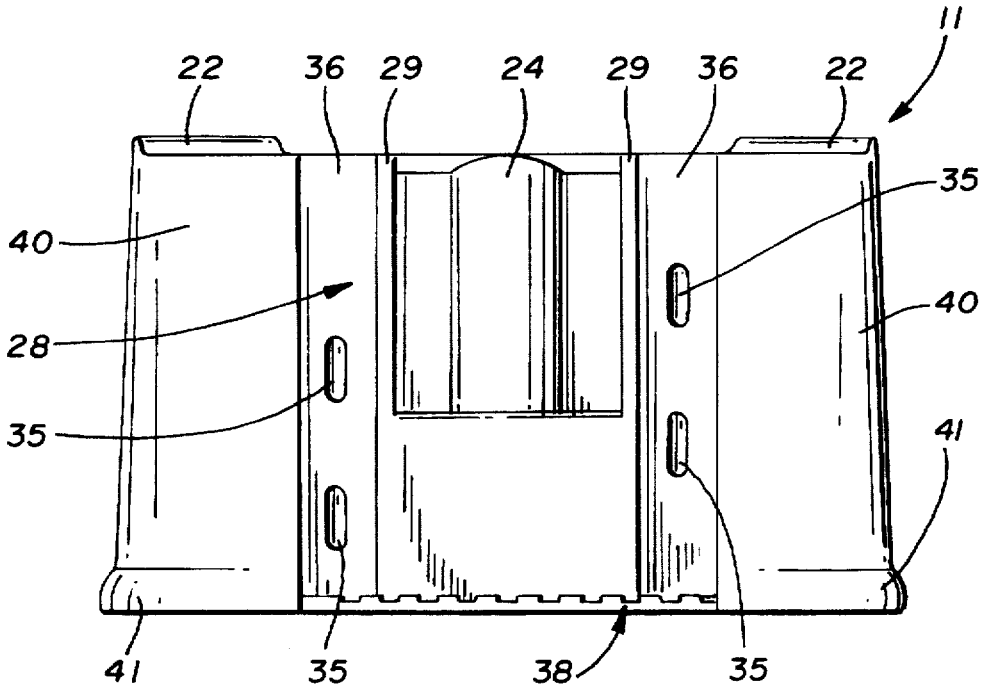
FIG. 4 is a rear elevational view of the upper section of the container taken substantially along line 4—4 of FIG. 2.
Figure 5:
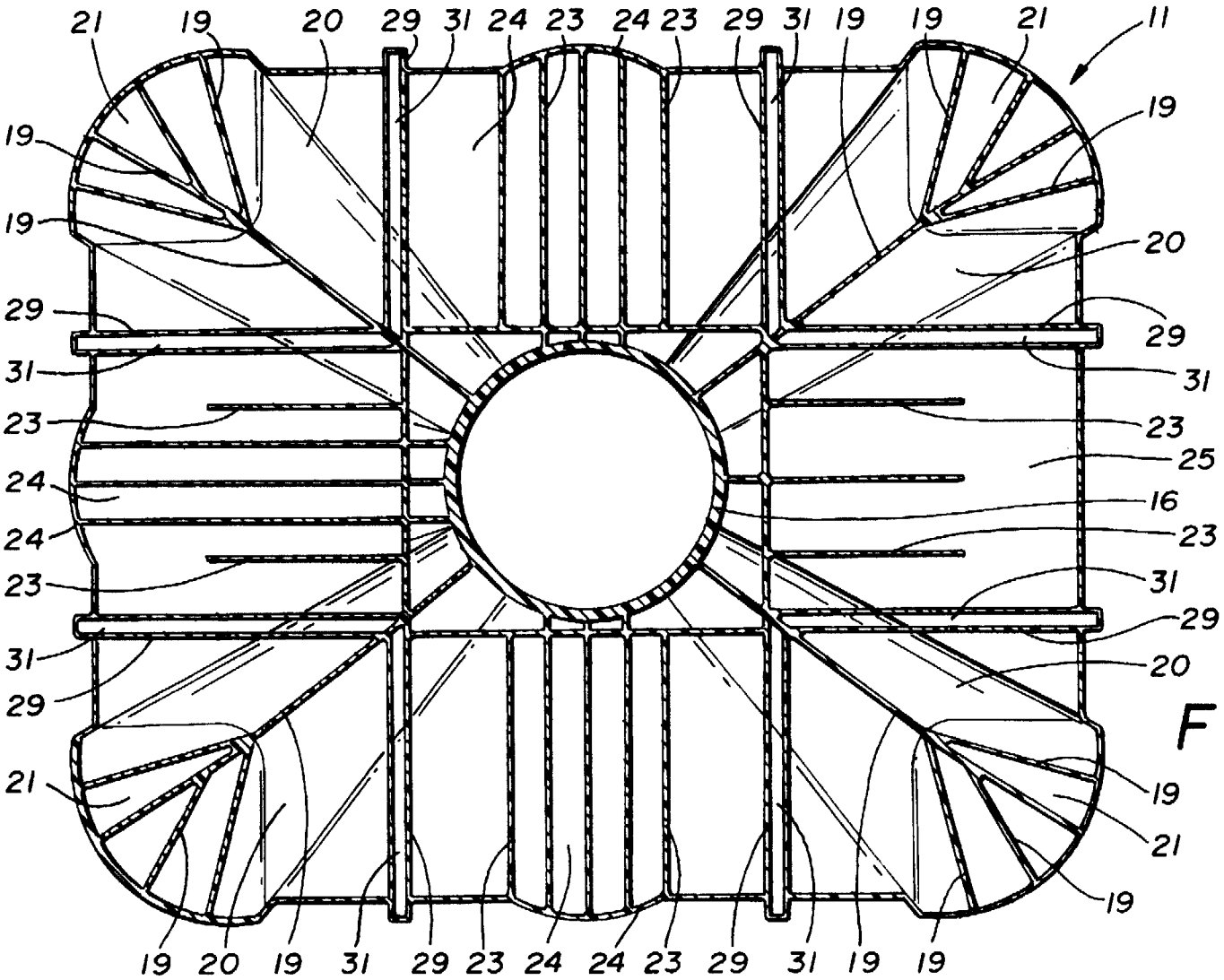
FIG. 5 is a sectional view taken substantially along line 5—5 of FIG. 3.

The sidewalls 26 and back wall 28 of upper section 11 are much the same in configuration as front wall 30 and thus like elements have been given the same reference numerals. Thus, as best shown in FIGS. 3 and 4, sidewalls 26 and back wall 28 each have the flat recessed surface 32 (onto which upper arcuate surfaces 24 extend), the flat raised surface 33, the recessed surfaces 34 with sightholes 35, the drainage ribs 29, the arcuate lips 36, the castellated surface 38, and corner columnar legs 40 with their arcuate skirts 41.

Figure 6:
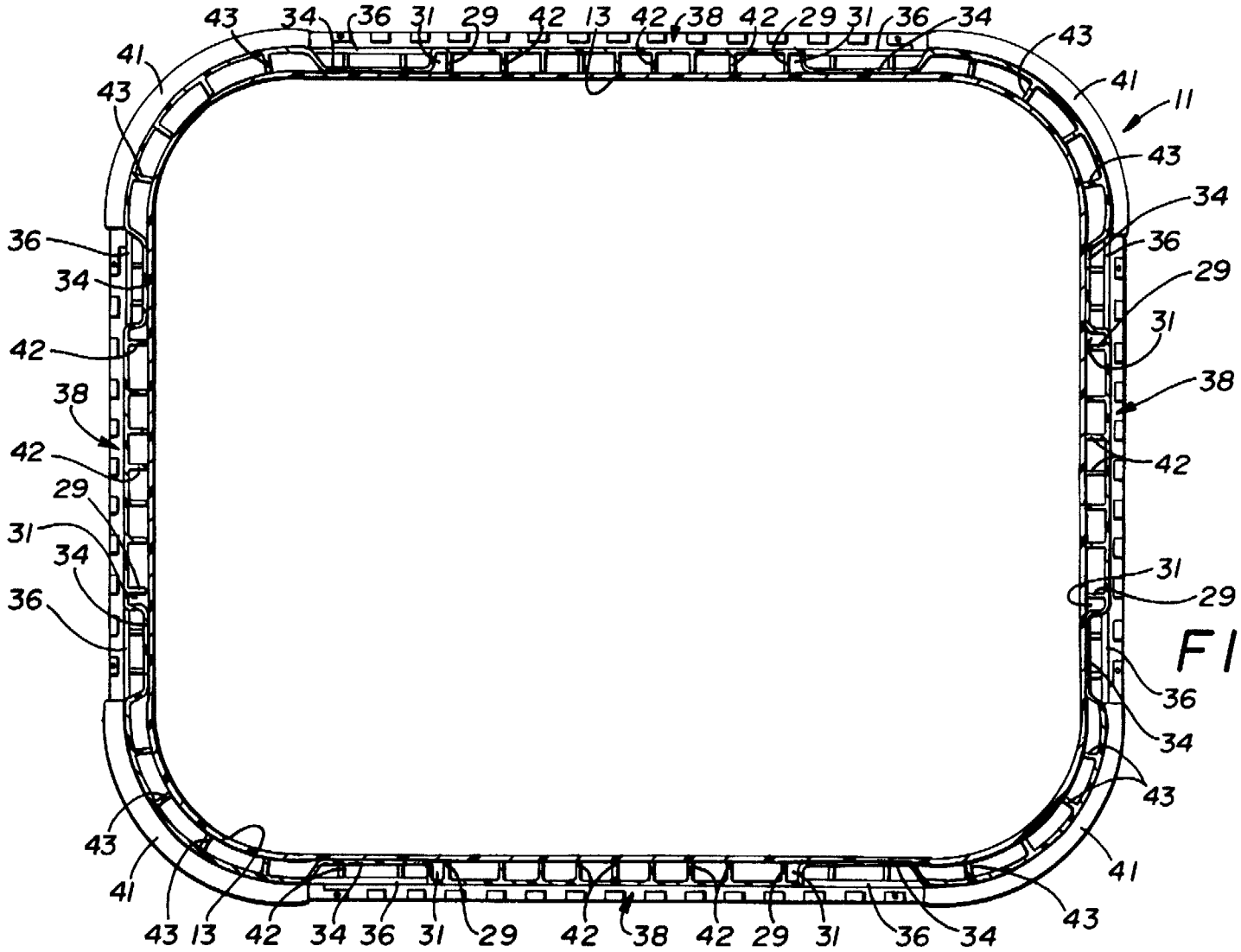
FIG. 6 is a sectional view taken substantially along line 6—6 of FIG. 3 and showing the internal bottle in place.

As shown in FIG. 6, sidewalls 26, back wall 28 and front wall 30 are all provided with vertical internal ribs 42 thereon which can be an extension of top ribs 23 or which can be separate and/or additional ribs. Ribs 42 not only provide structural support for walls 26, 28 and 30, but also support the walls of bottle 13 when it is full of material as will be more fully hereinafter described. Similar corner ribs 43 are also provided for the same purposes. Ribs 43 are preferably a downward extension of ribs 19.

Figure 7:
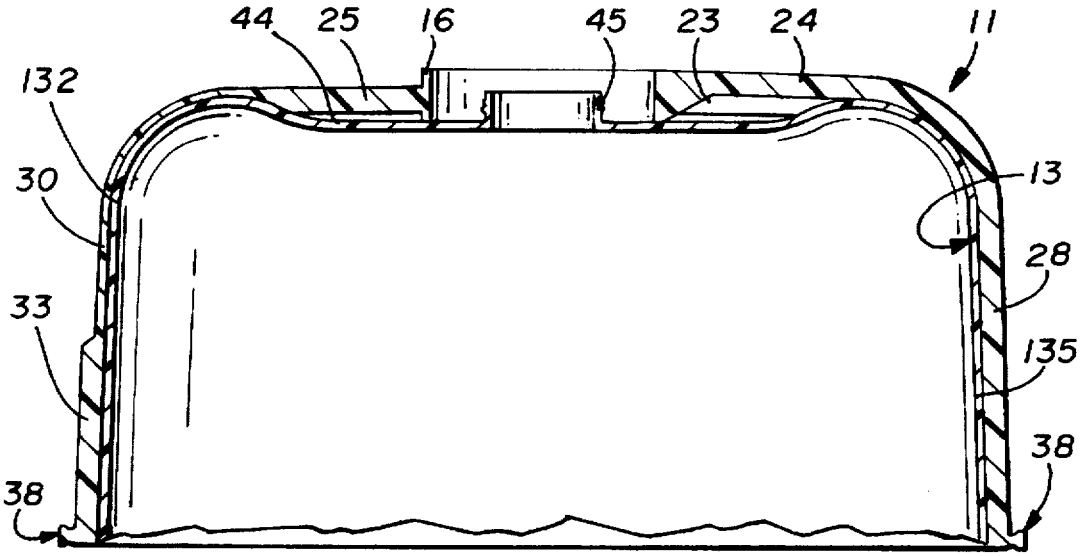
FIG. 7 is a fragmented sectional view of the upper section of the container taken substantially along line 7—7 of FIG. 2.
Figure 8:
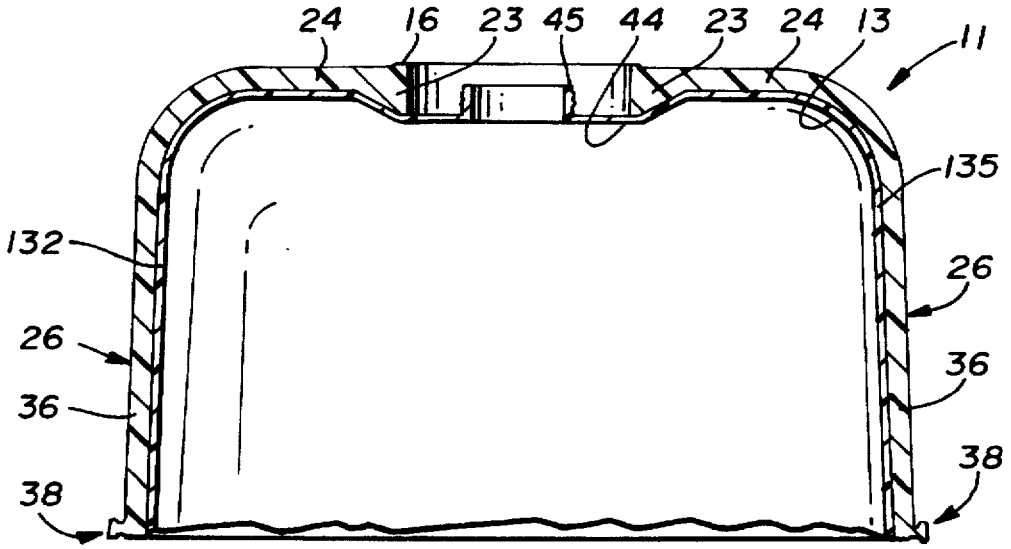
FIG. 8 is a fragmented sectional view of the upper section of the container taken substantially along line 8—8 of FIG. 2.

As shown in FIGS. 7 and 8, top ribs 23, near central hub 16, extend downwardly to hold down the peripheral area 44 around neck 45 of bottle 13. When bottle 13 is in an expanded condition, as shown in FIG. 8, bottle 13 may even extend into the area defined by upper arcuate surfaces 24. As will be hereinafter described, with the expansion space provided between ribs 42 and 43, and with the support provided by ribs 42 and 43, such tends to fully confine bottle 13 in its proper position.

With reference to FIGS. 1 and 9–17, lower shell or section 12 will now be described in detail. Except that it has an open top, lower section 12 is in most respects like upper section 11. As such, it includes a front wall indicated generally by the numeral 46 having a flat surface 48 complementing upper section surface 33, and two recessed surfaces 49 to the sides thereof which carry staggered sightholes 50. The top of surface 48, together with arcuate lips 51 positioned above surfaces 49, carry a castellated surface, generally indicated by the numeral 52, which mates with castellated surface 38 of upper section 11 to form part of the connection mechanism 39.

Drainage ribs 53 are formed between surface 48 and surfaces 49 to mate with similar ribs 29 of upper section 11 and extend, with their internal drainage channel 54 (FIG. 16), to the bottom of lower section 12. Below surface 48 of front wall 46 is a plate 55 reinforced by ribs 56 which defines a pocket or opening 58 (FIG. 11) in front of wall 46 for a valve assembly, generally indicated by the numeral 59, of bottle 13. Pocket 58 may be opened and closed, for access to and the protection of valve assembly 59, by a valve access closure mechanism, generally indicated by the numeral 60, shown in a closed position in FIG. 1, and shown in detail in FIGS. 32–34, to be hereinafter described.

On each side of recessed surfaces 49, columnar corner legs 61 are formed to mate with legs 40 of upper section 11.

When mated together, columnar legs 40 and 61 provide extraordinary strength to container 10. An arcuate skirt 62 is formed at the top of legs 61 to mate with skirt 41 and form the protective mechanism for connection mechanism 39 as previously described.

Figure 17:
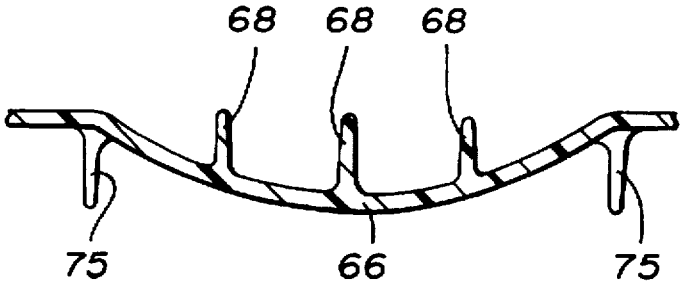
FIG. 17 is a fragmented sectional view taken substantially along line 17—17 of FIG. 9.

The sidewalls 63 of lower section 12 are much the same in configuration as front wall 46 and thus like elements have been given the same reference numerals. The rear wall 64 (FIG. 16) of lower section 12 is essentially identical to the sidewalls 63 and is therefore not shown in detail. Sidewalls 63 therefore include the flat surface 48, the recessed surfaces 49, the sightholes 50, the upper arcuate lips 51, the castellated surface 52, the drainage ribs 53, and the columnar legs 61 having upper skirts 62. Instead of the valve pocket 58, however, sidewalls 63 have a recessed flat wall 65 positioned below wall 48 with a downwardly directed raised arcuate surface 66 positioned thereon which ties together a plurality of support ribs 68 that also extend into the bottom of lower section generally indicated by the numeral 69 (FIGS. 9 and 17).

Also like upper section 11, as shown in FIG. 6, front wall 46, sidewalls 63 and rear wall 64 of lower section 12 are all provided with vertical internal ribs 70 thereon which not only provide structural support for walls 46, 63 and 64, but also support the walls of bottle 13 when filled. Similar internal corner ribs 71 can also be provided for the same purpose. This support is enhanced by the fact that bottle 13 may expand, as necessary, into the spaces between ribs 70 and ribs 71 just as previously described with respect to ribs 42 and 43 of upper section 11. Such prevents rupture of bottle 13 under expansion conditions.

Figure 9:
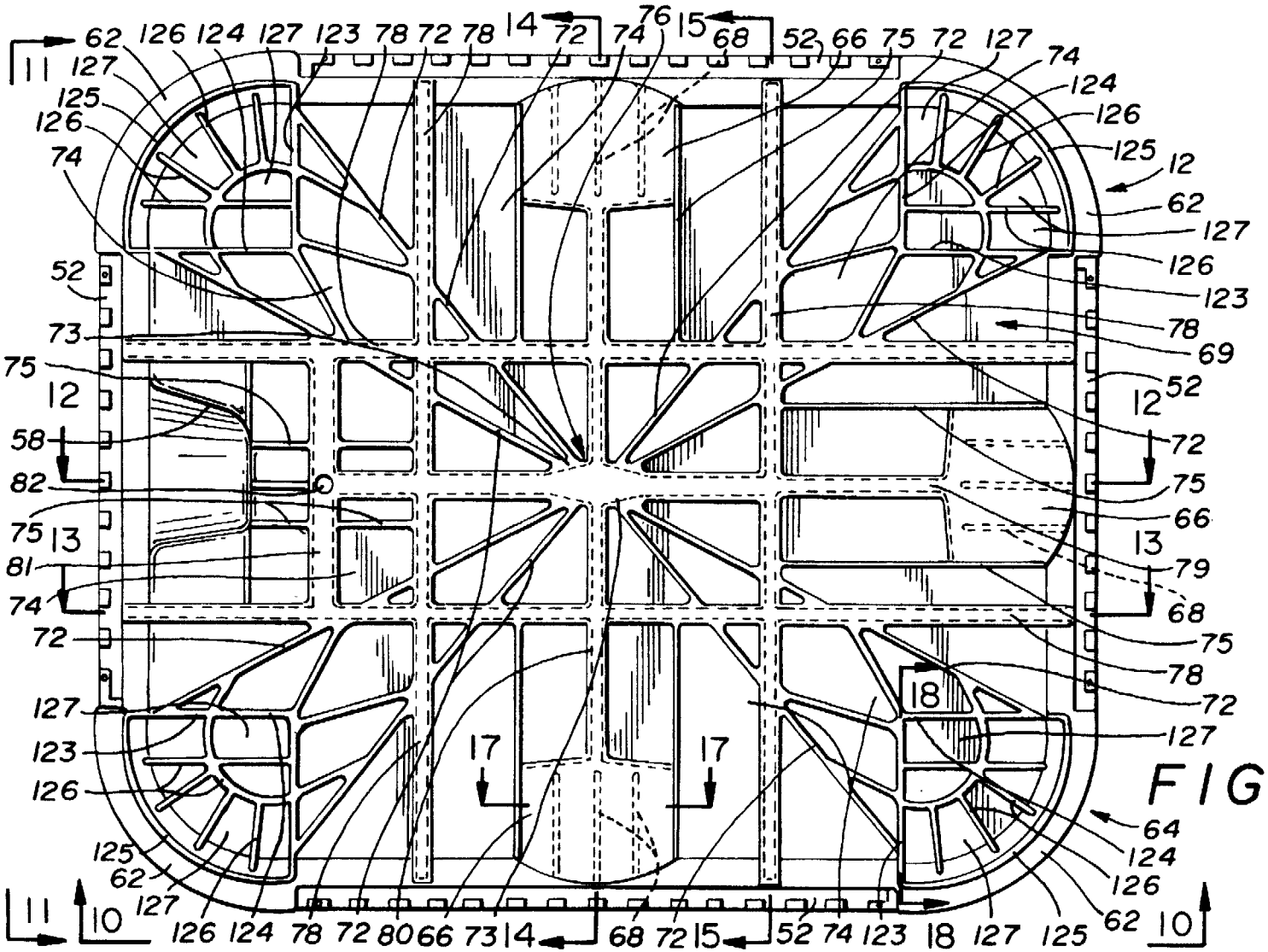
FIG. 9 is a bottom plan view of the container of FIG. 1.
Figure 10:
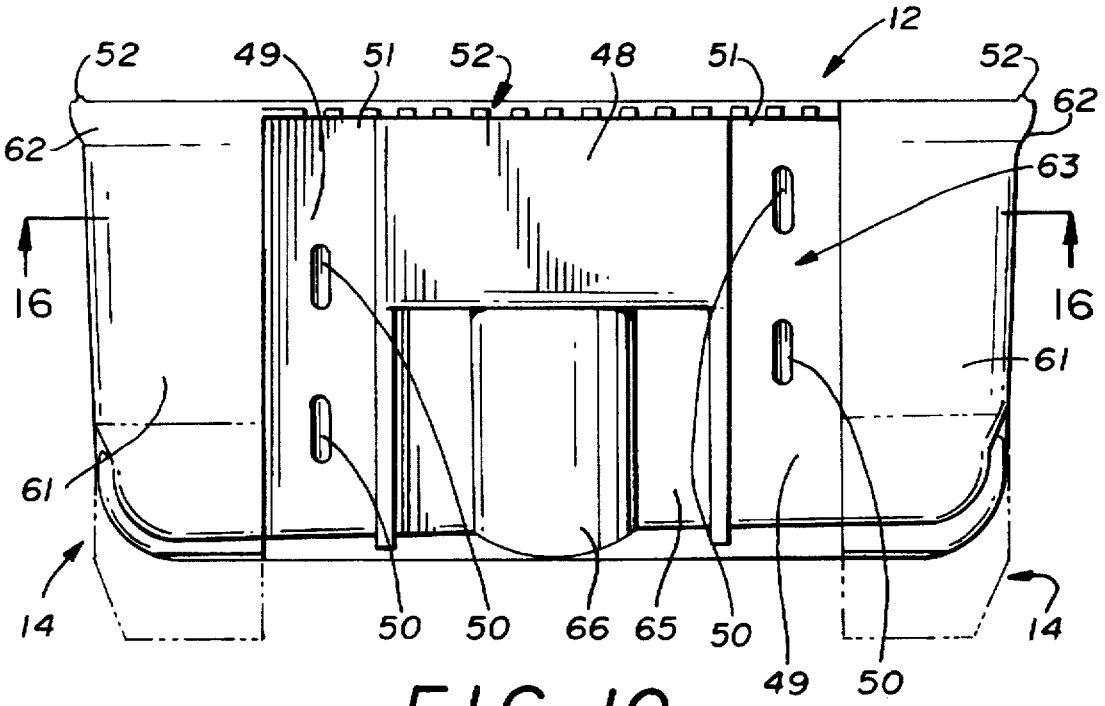
FIG. 10 is a side elevational view of the lower section of the container taken substantially along line 10—10 of FIG. 9 and showing two feet of the container in phantom.
Figure 11:
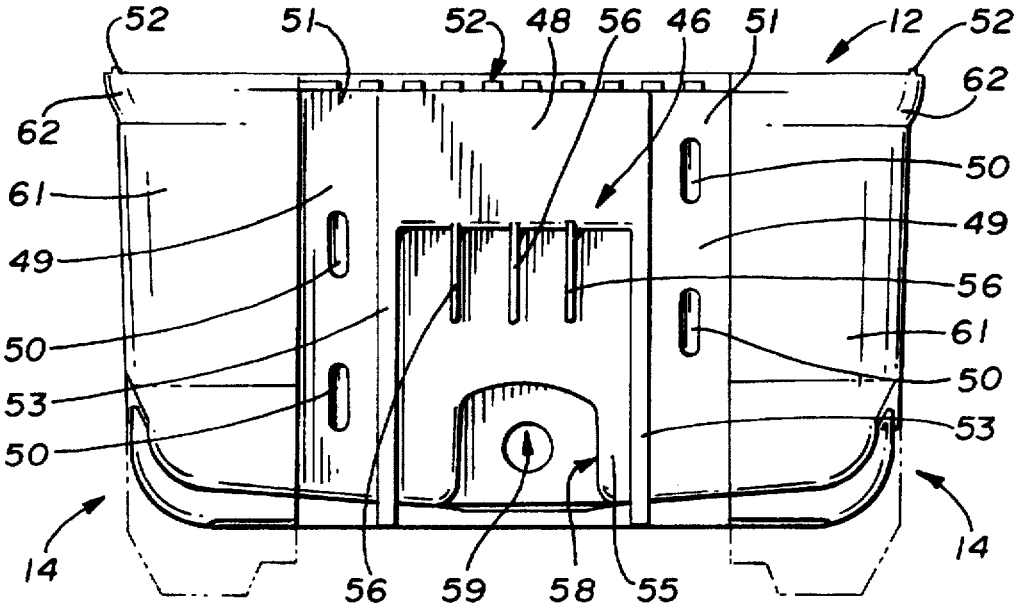
FIG. 11 is a front elevational view of the lower section of the container taken substantially along line 11—11 of FIG. 9 and showing two feet of the container in phantom.
Figure 12:
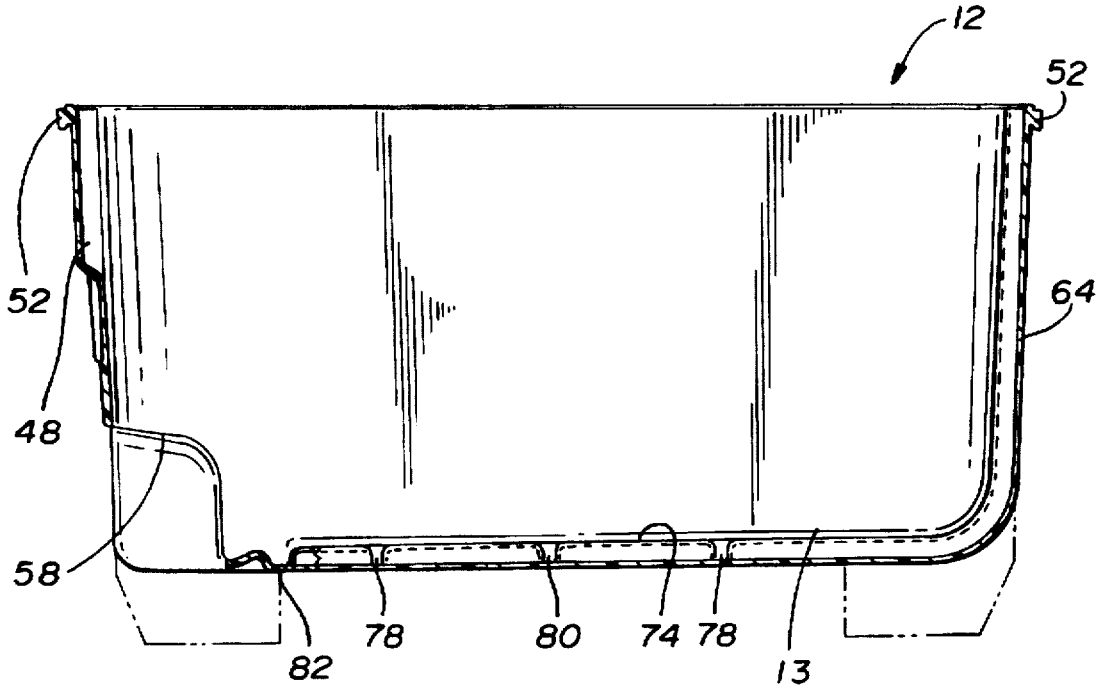
FIG. 12 is a sectional view of the lower section of the container taken substantially along line 12—12 of FIG. 9 and showing two feet of the container in phantom.
Figure 13:
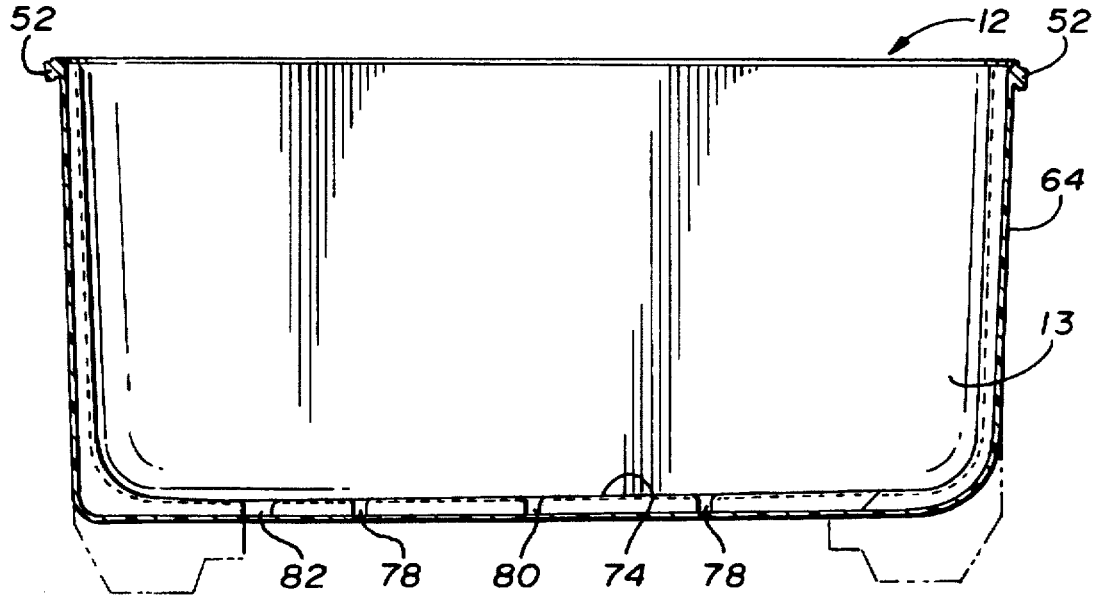
FIG. 13 is a sectional view of the lower section of the container taken substantially along line 13—13 of FIG. 9 and showing two feet of the container in phantom.
Figure 14:
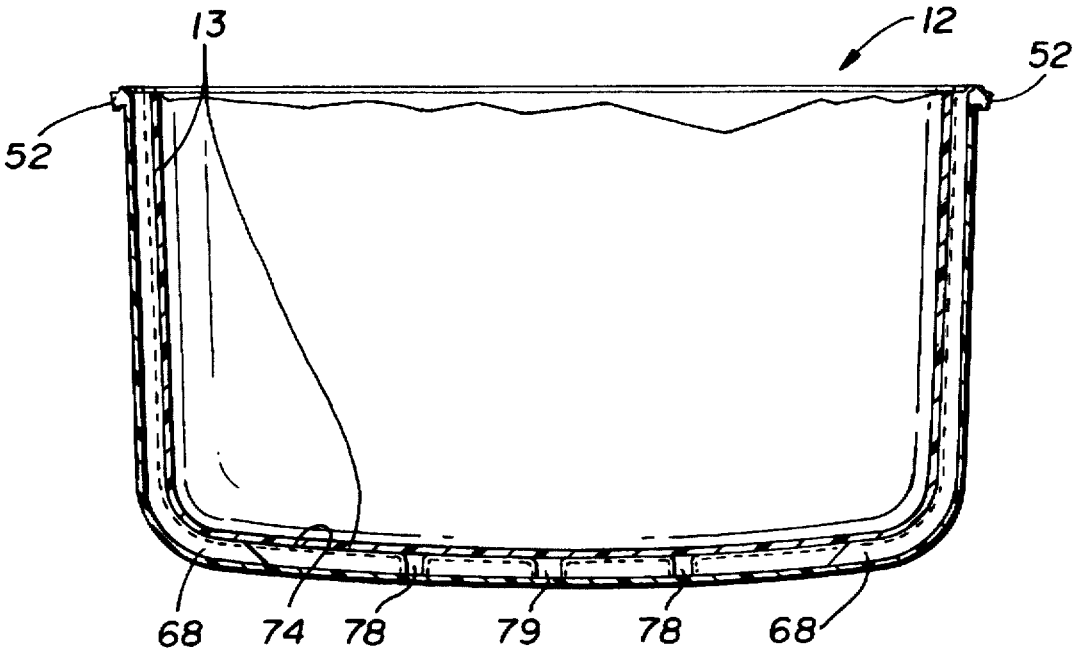
FIG. 14 is a sectional view of the lower section of the container taken substantially along line 14—14 of FIG. 9.
Figure 15:
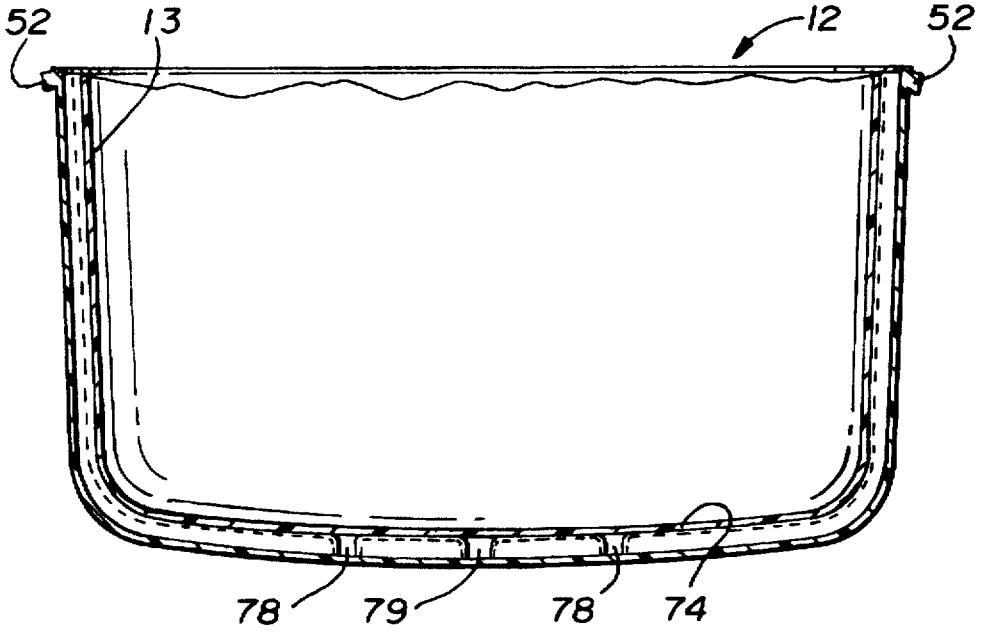
FIG. 15 is a sectional view of the lower section of the container taken substantially along line 15—15 of FIG. 9.
Figure 16:
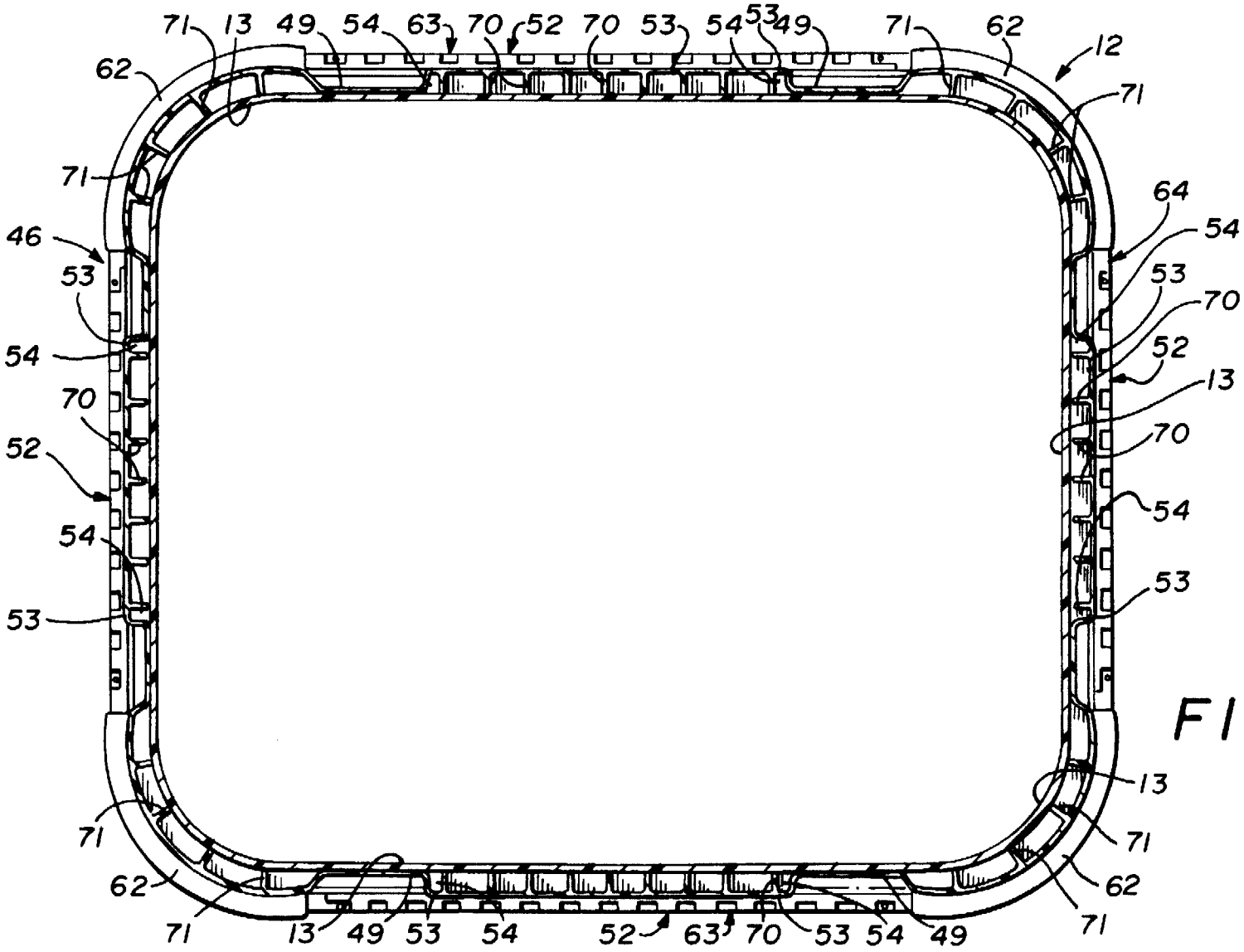
FIG. 16 is a sectional view taken substantially along line 16—16 of FIG. 10 and showing the internal bottle in place.

The bottom 69 of lower section 12 is best shown in FIG. 9. As shown, a plurality of external support ribs 72 radiate outwardly from a central hub 73 generally diagonally toward the corners. These ribs extend downwardly from the bottom surface 74 of lower shell 12. Additional ribs 75 are located at various locations on the underside of bottom surface to assist in supporting, along with ribs 73, a drainage system, generally indicated by the numeral 76 and now to be described.

As best shown in FIGS. 9 and 12–15, for containers designed to carry liquids, drainage system 76 may be provided and includes a network of channels or troughs formed in the bottom 69 of lower section 12. As such, drainage system 76 includes four primary channels 78, two extending from side to side and two extending from front to back. System 76 also includes a central front-to-back channel 79 and a central side-to-side channel 80 which intersect generally at the area of rib hub 73. Another feeder channel 81 extends between side-to-side primary channels 78 and intersects with one end of channel 79. A drain hole 82 through bottom surface 69 is provided at that intersection, and all of the network of channels are sloped downwardly toward drain hole 82 so that any liquid which reaches any of the channels and below bottle 13 may pass through drain hole 82 if desired. If such is not desired, a plug may be positioned in drain hole 82. Even liquid which may accumulate at the top or sides of bottle 13 is conveyed to drain hole 82 because the eight ends of primary channels 78 communicate with the bottom of drainage channels 54 in lower section 12 which, in turn, communicate with drainage channels 31 in upper section 11.

The manner in which upper section 11 is attached to lower section 12 by means of connection mechanism 39 is shown in detail in FIGS. 19–22. Each castellated surface 38 of upper section 11 includes a series of lugs 83 separated by spaces 84. A notch 85 is formed at the top of and behind the outer surface of each lug 83, and a groove 86 is formed underneath each lug 83, that is, opposed to notch 85. Similarly, each castellated surface 52 of lower section 12 is provided with a series of lugs 88 separated by spaces 89. A notch 90 is formed at the bottom of and behind the outer surface of each lug 88 and a tongue 91 is positioned at the top of each lug 88 opposed to notch 90.

Figure 19:
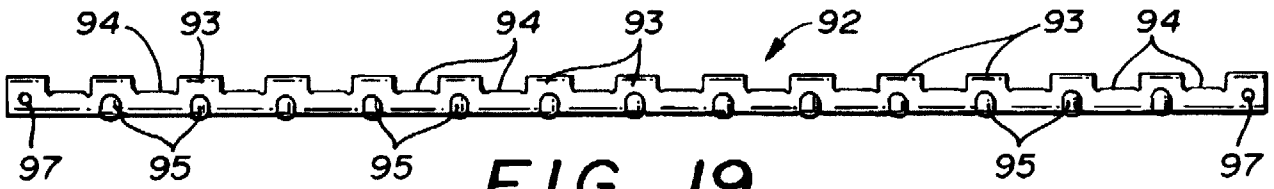
FIG. 19 is a top plan view of the mechanism which assists in fastening the upper section of the container to the lower section of the container.
Figure 20:
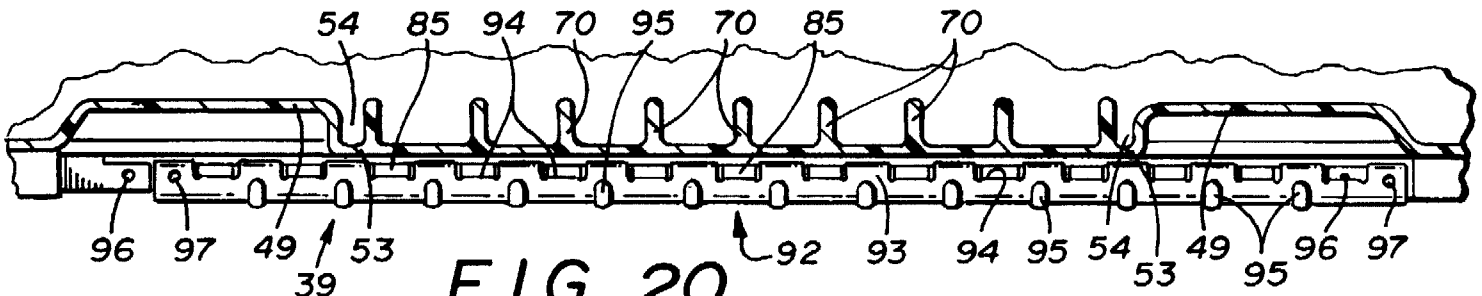
FIG. 20 is a fragmented, partially sectional view, showing the first step in the application of the mechanism shown in FIG. 19 to the upper and lower sections of the container.
Figure 21:
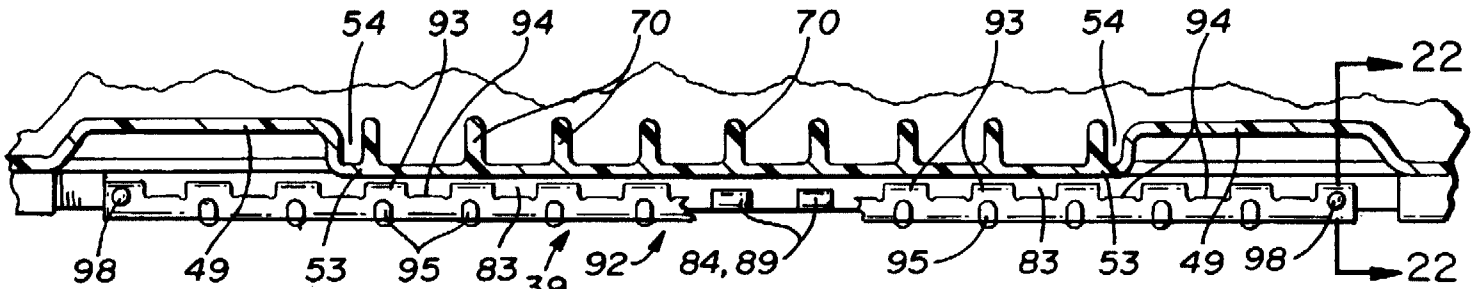
FIG. 21 is a fragmented, partially sectional view, showing the step sequentially following FIG. 20 in the application of the mechanism shown in FIG. 19 to the upper and lower sections of the container to lock the sections together.
Figure 22:
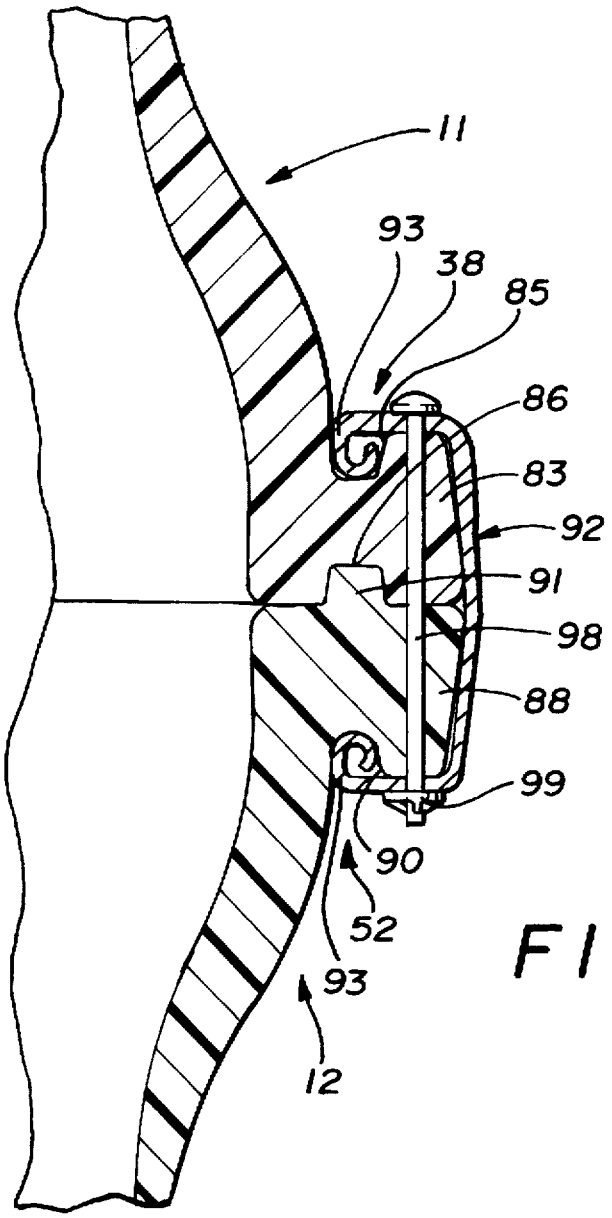
FIG. 22 is an enlarged, fragmented, sectional view taken substantially along line 22—22 of FIG. 21.

A C-shaped clip is shown in FIG. 19 and is generally indicated by the numeral 92. A clip 92 is provided for each wall of container 10, and each clip 92 is shown as being an elongate member having opposed upper and lower tongs 93 alternating with recesses 94, the tongs being formed at the ends of the branches of the C shape. The back of the C-shaped clip 92 is provided with a plurality of darts 95 to stiffen the same as would be evident to one skilled in the art. To connect upper section 11 to lower section 12, first lugs 83 are aligned with lugs 88 as the lower open end of upper section 11 is placed on the upper open end of lower section 12. The alignment is simplified and the connection is assured because tongue 91 is received in groove 86. In fact, it is preferable that tongue 91 and groove 86, in addition to being formed in lugs 88 and 83, respectively, are also provided along the entire peripheries of upper section 11 and lower section 12. Then, as shown in FIG. 20, clip 92 can be positioned on castellated surfaces 38 and 52 by pushing tongs 93 into aligned spaces 84 and 89. Of course, at the same time, lugs 83 and 88 are received within recesses 94 of clip 92. Clip 92 may then be slid to the left, as viewed in FIG. 20, to the FIG. 21 position. As such, tongs 93 slide in notches 85 and 90 and behind lugs 83 and 88 such that recesses 94 are then aligned with spaces 84 and 89. The movement from the FIG. 20 to the FIG. 21 position also aligns complementary apertures 96, formed near each end of castellated surfaces 38 and 52, with apertures 97 formed near each end of clips 92. Bolts 98 may then be inserted through aligned apertures 96 and 97, and when nut 99 is tightened, the connection is complete. In addition to making the connection of upper section 11 to lower section 12, it should also be appreciated that the connection mechanism 39 adds hoop strength to container 10 to prevent any tendency of the container to bulge at the middle.

If desired to seal container 10 so that any liquid therein not in bottle 13 would not seep out, a conventional o-ring seal (not shown) could be utilized at the junction of upper section 11 and lower section 12 as would be evident to one skilled in the art. Such secondary containment of any such liquid would also of course require that drain hole 82 be plugged and sealed and that all other areas of possible leakage, for example, at the area of valve assembly 59, also be sealed, as would also be evident to one skilled in the art.

It should also be appreciated that the height and therefore the size of container 10 could be rendered adjustable by providing a spacer, not shown in the drawings, between upper section 11 and lower section 12. Such a spacer would be open at the bottom and top and would have side walls with a castellated surface at the top and bottom thereof to mate with the castellated surfaces 38 and 52. Additional clips 92 would attach the spacer to the upper and lower sections thereby providing even additional hoop strength. As such, the height of container 10 could be adjusted to essentially any size dependent on the height of the spacer selected.

Figure 23:
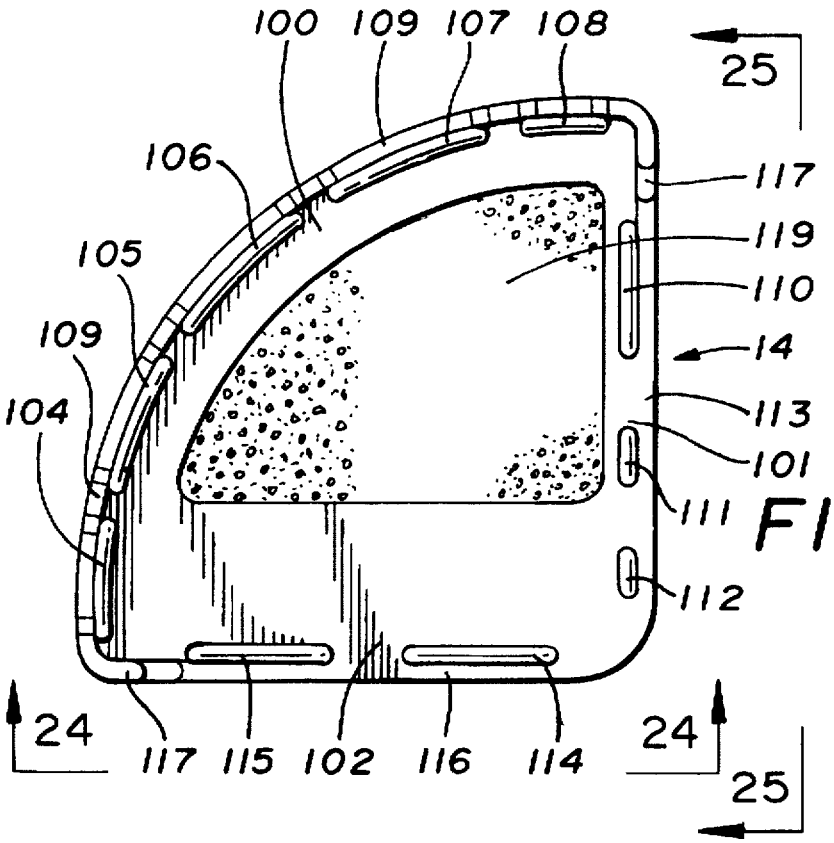
FIG. 23 is a top plan view of a foot for the container.
Figure 24:
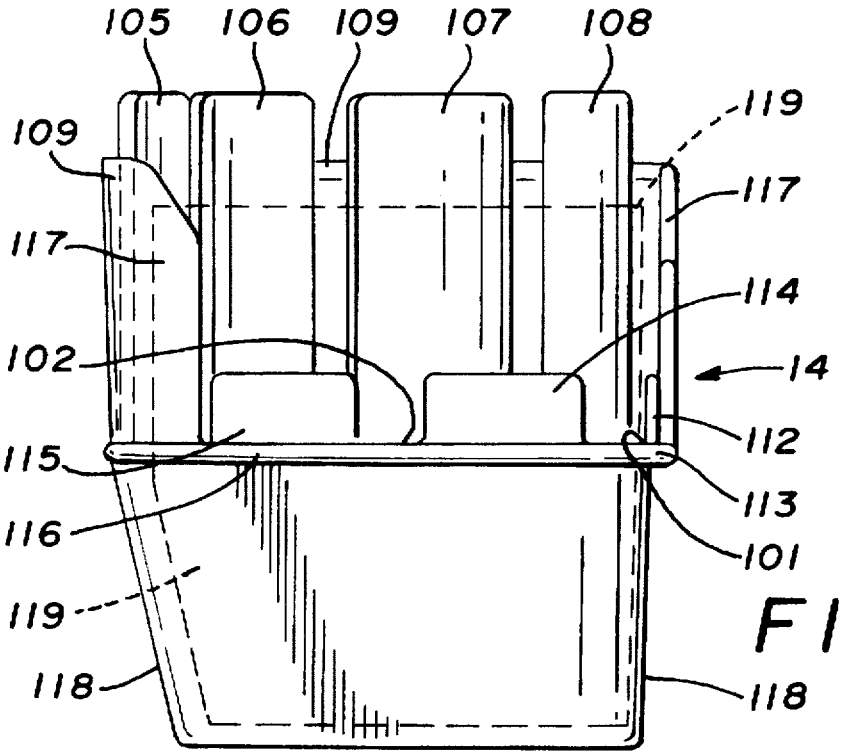
FIG. 24 is a side elevational view of a foot for the container taken substantially along line 24—24 of FIG. 23.
Figure 25:
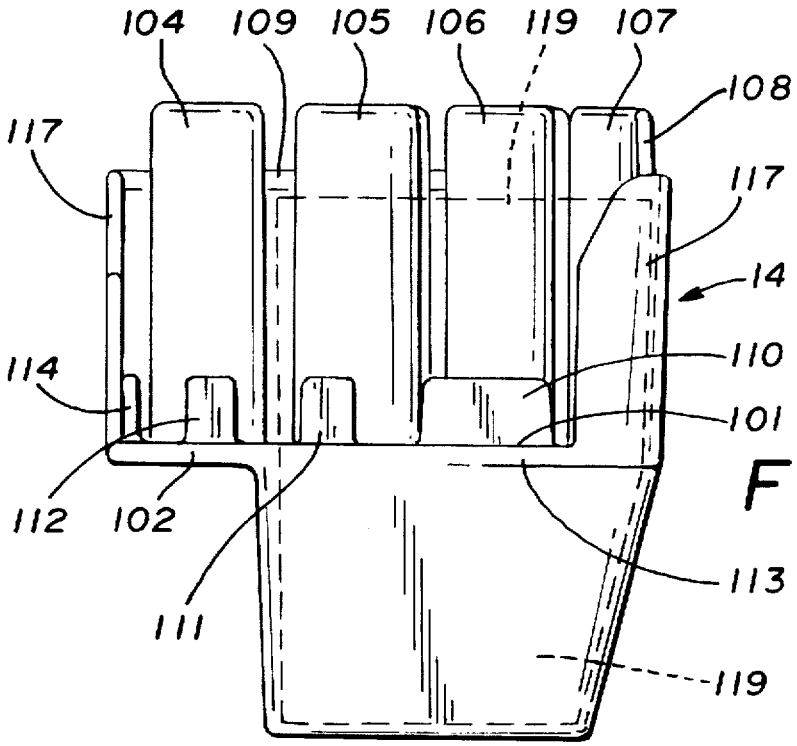
FIG. 25 is a side elevational view of a foot for the container taken substantially along line 25—25 of FIG. 23.

Container 10 is supported by unique feet 14 now to be described with particular reference to FIGS. 23–26. As shown in FIG. 23, each foot 14, in plan view, takes on the profile of a pie-shaped quarter of a circle having an arcuate ledge 100 and radial or linear ledges 101 and 102, with ledge 102 extending inwardly further than ledge 101. A plurality of arcuate, spaced, long tabs 104, 105, 106, 107 and 108 extend upwardly from and are spaced slightly inwardly from the edge of ledge 100, the tabs also extending upwardly above an upper arcuate bevelled lip 109. Three spaced short tabs 110, 111 and 112 extend upwardly from and are spaced slightly inwardly from the edge of ledge 101, the space forming a lower linear lip 113. Two spaced shorter tabs 114 and 115 extend upwardly from and are spaced slightly inwardly from the edge of ledge 102, the space forming a lower linear lip 116. Transition surfaces 117 extend downwardly from the ends of upper arcuate lip 109 to the ends of lower linear lips 113 and 116, as shown in FIGS. 24 and 25, with linear lips 113 and 116 intersecting at their other ends.

Figure 26:
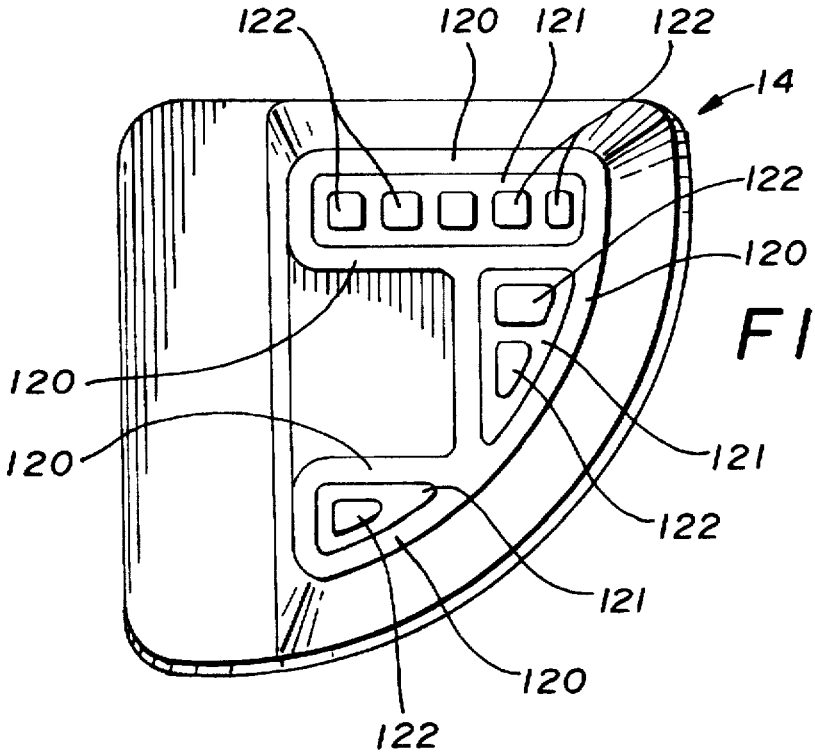
FIG. 26 is a bottom plan view of a foot for the container.

A substantially hollow foot member 118, open at the top, extends downwardly from ledges 100, 101 and 102. A block of energy-absorbing foam 119, preferably made of a polyurethane material, is inserted into each foot member 118 to substantially fill the same and, as shown by the dotted lines in FIGS. 24 and 25, extends upwardly to approximately the height of upper lip 109 and between all of the tabs. As shown in FIG. 26, the bottom 119 of each foot member 118 is preferably pie-shaped in profile and is provided with a downwardly depending, irregularly-shaped tread pattern 120 having recessed areas 121 therebetween. A plurality of friction pads 122, extending to the same level as tread pattern 120, may be provided in recessed areas 121. Because the ledges 20 of top surface 15 of upper section 11 take on substantially the same pie shape profile as does the bottom 119 of each foot member, the manner in which feet 14 may securely stack on ledges 21, being located and confined by surfaces 22 of a similar or like container, as previously described, can readily be seen.

Figure 18:
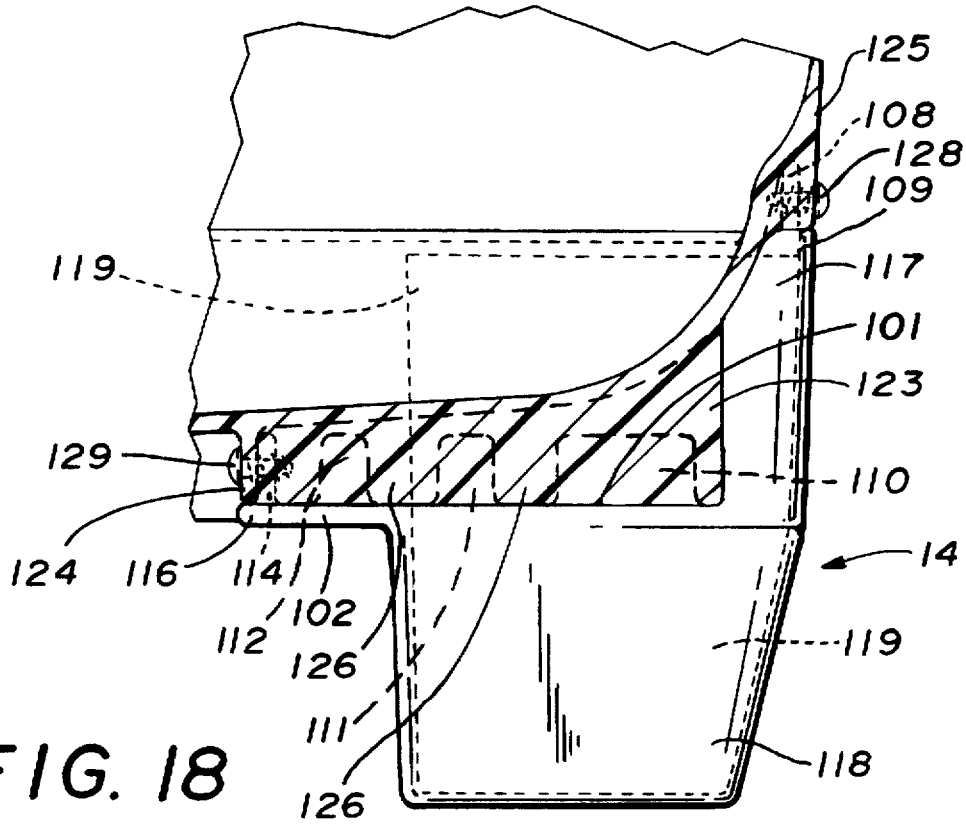
FIG. 18 is a fragmented sectional view of a corner of the lower section and a foot of the container taken substantially along line 18—18 of FIG. 9.

The manner in which each foot 14 may be attached to and interrelate to lower section 12 is best shown with specific reference to FIG. 18 and to FIG. 9. FIG. 18 shows the side of a foot 14 as viewed in FIG. 25 which would be received on the bottom of lower section 12, at the lower right-hand corner as viewed in FIG. 9. As shown in FIG. 9, a rib pattern of a pie-shaped quarter of a circle is formed at each corner of the bottom of lower section 12 at the ends of ribs 72 and includes radial ribs 123 and 124 connected to each other at their inner end and connected at their outer end to an arcuate rib 125. Additional ribbing 126 is provided and effectively forms ten spaces 127 along and between ribs 123, 124 and 125 to receive the ten tabs of foot 14 adjacent thereto. Thus, each tab is positioned just inside of ribs 123, 124 and 125, with each of the ten tabs of foot 14 being received between adjacent ribbing 126. At least selected of the tabs are connected to their adjacent ribs. For example, as shown in FIG. 18, tab 108 is connected by a suitable fastener 128 to rib 125, as the bottom of rib 125 rests on upper arcuate lip 109, and tab 114 is connected by a suitable fastener 129 to rib 124, as the bottom of rib 124 rests on lower linear lip 116. With all feet so connected, bottle 13 within container 10 is protected from rupture in the event the container is dropped in a manner now to be described.

Figure 27:
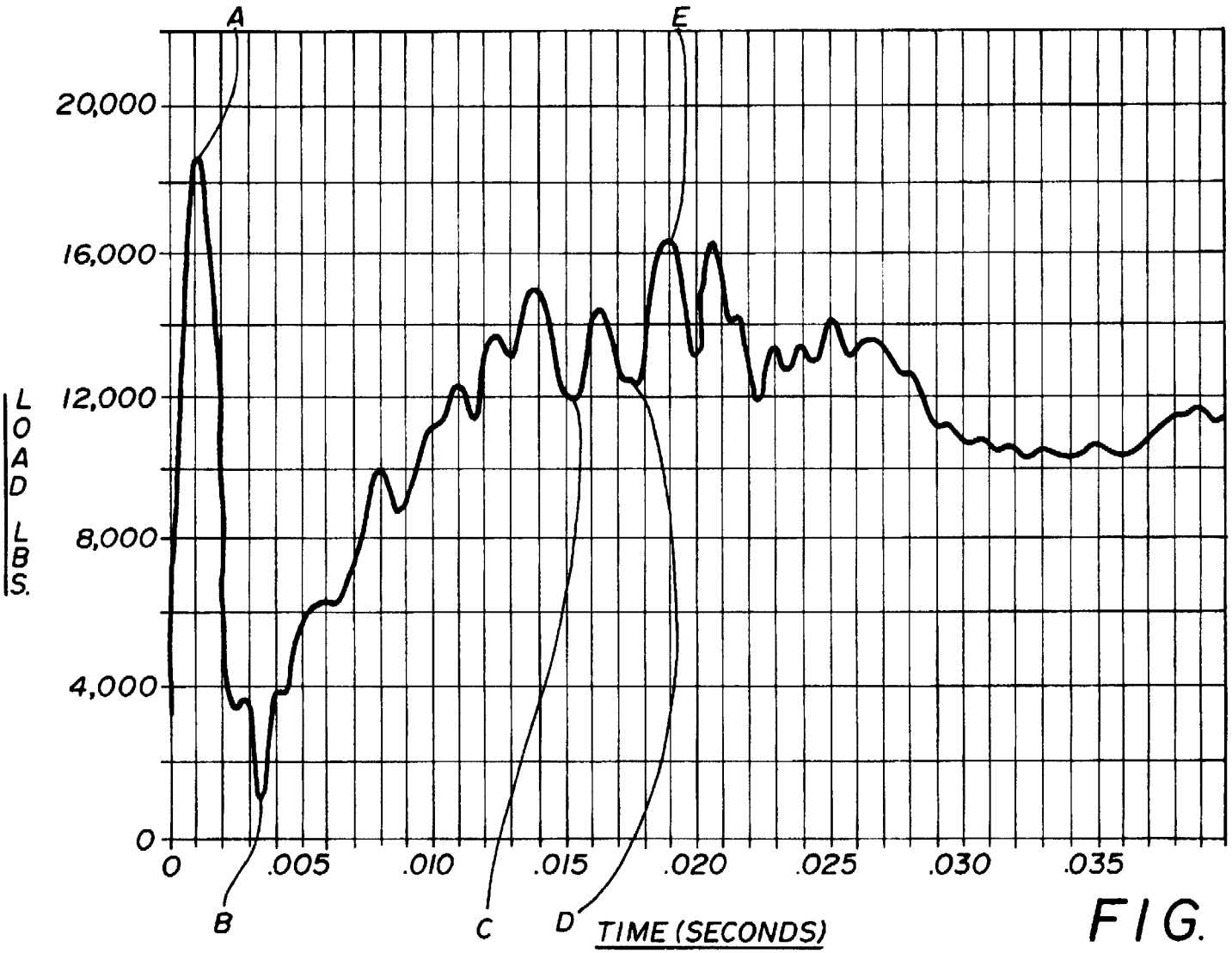
FIG. 27 is a somewhat schematic graph plotting load in pounds versus time demonstrating how the feet of the container absorb the energy in the event the container is dropped.
Figure 28:
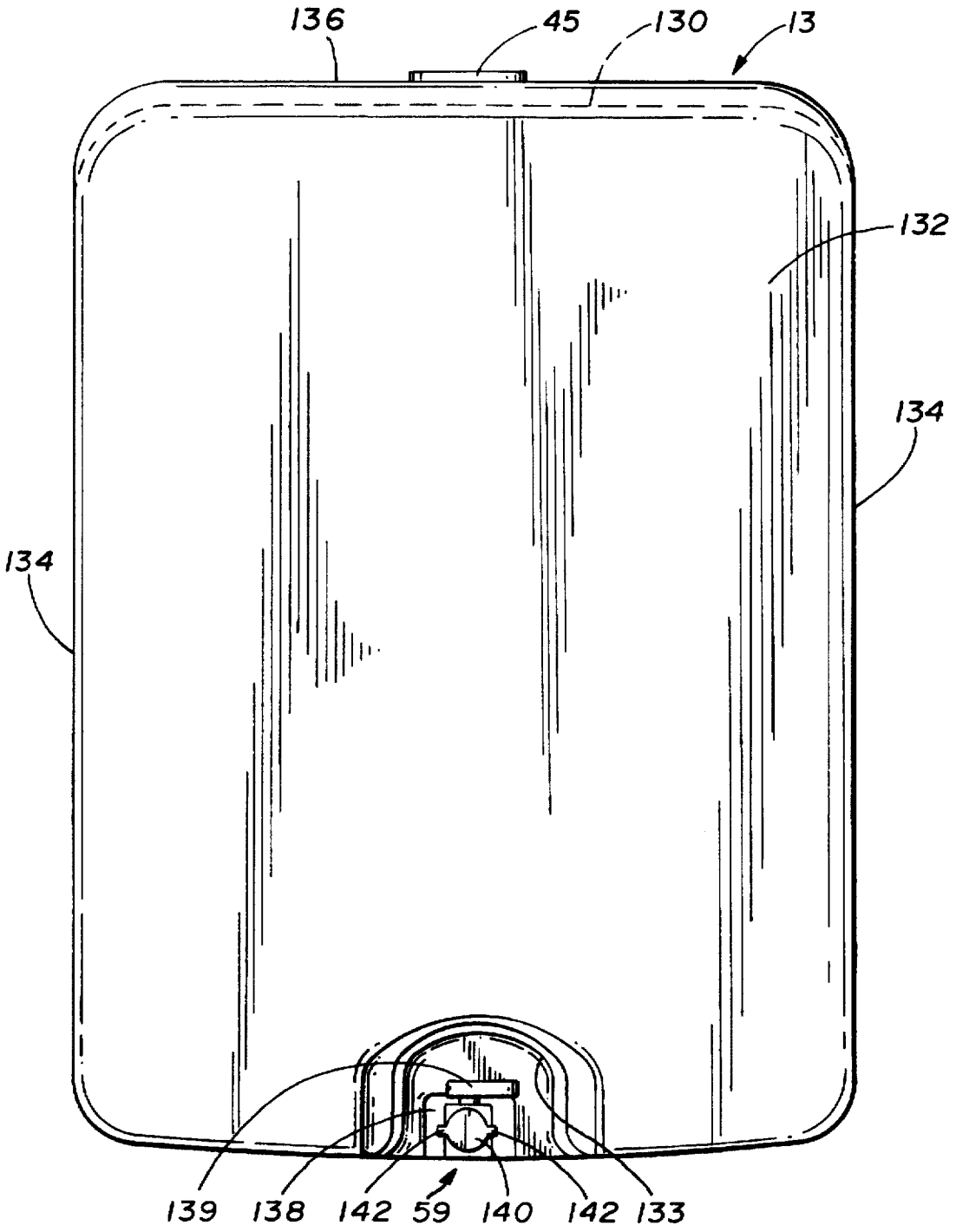
FIG. 28 is a front elevational view of the internal bottle for the container.
Figure 29:
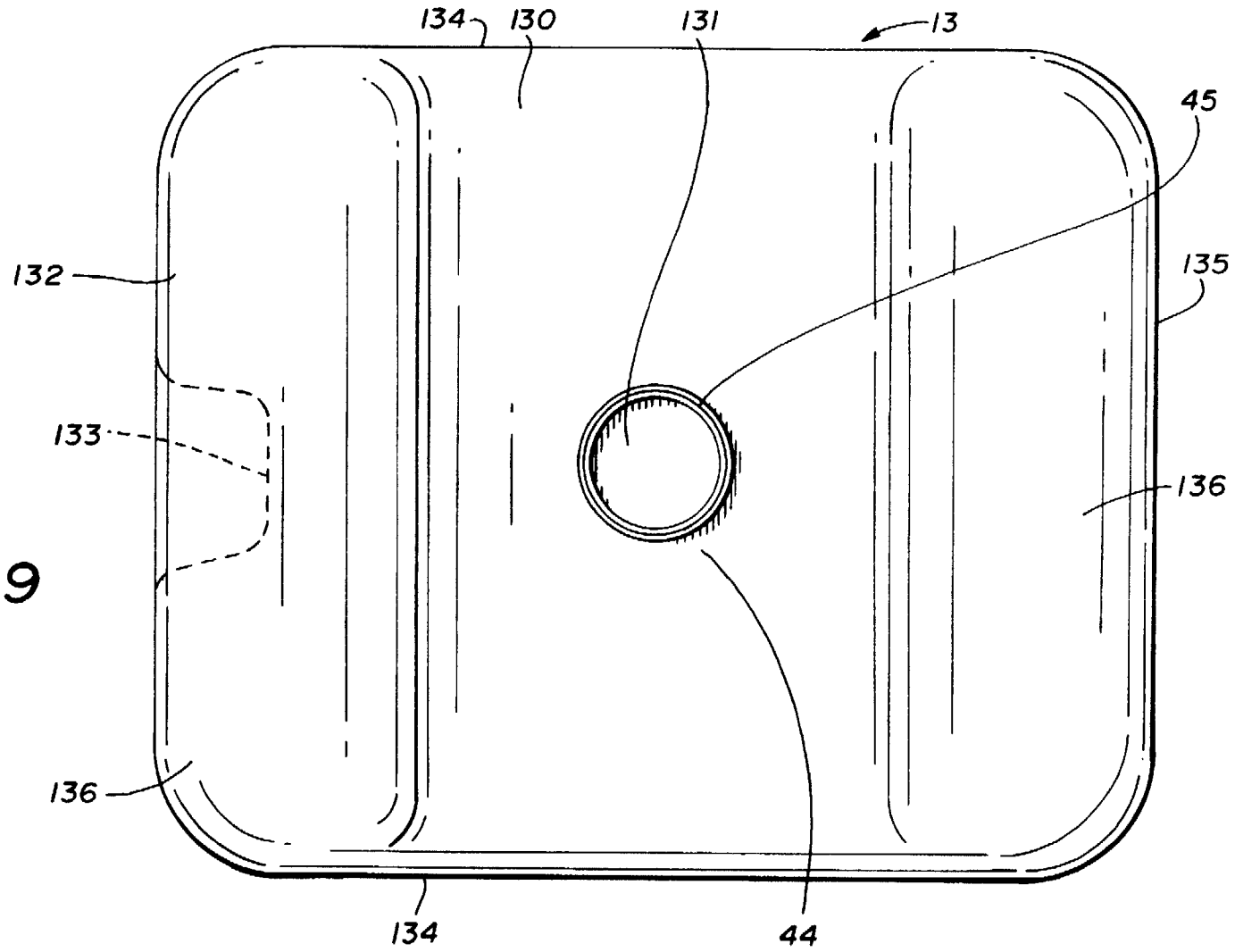
FIG. 29 is a top plan view of the bottle of FIG. 28.
Figure 30:
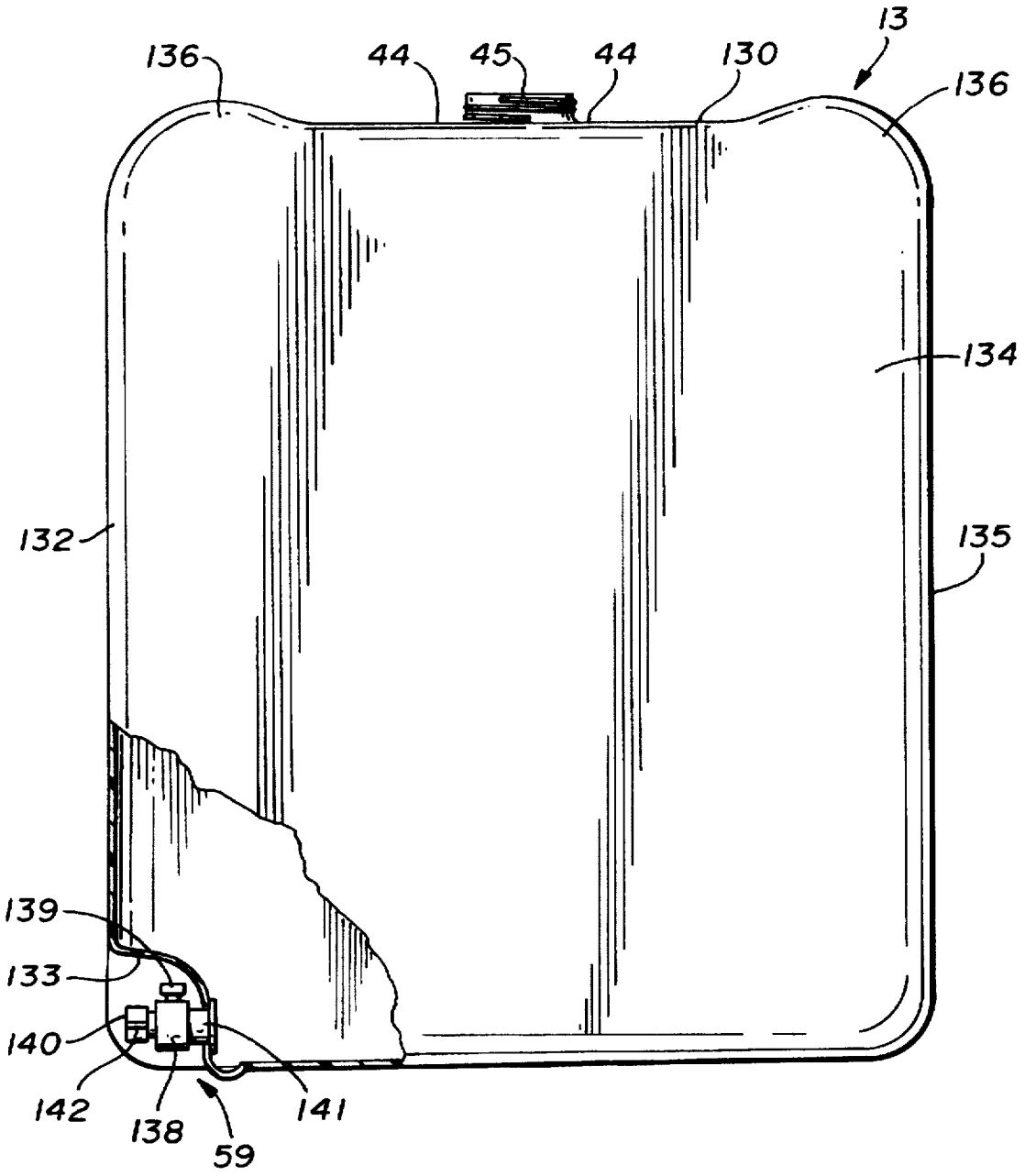
FIG. 30 is a side elevational view of the bottle of FIG. 28.
Figure 31:
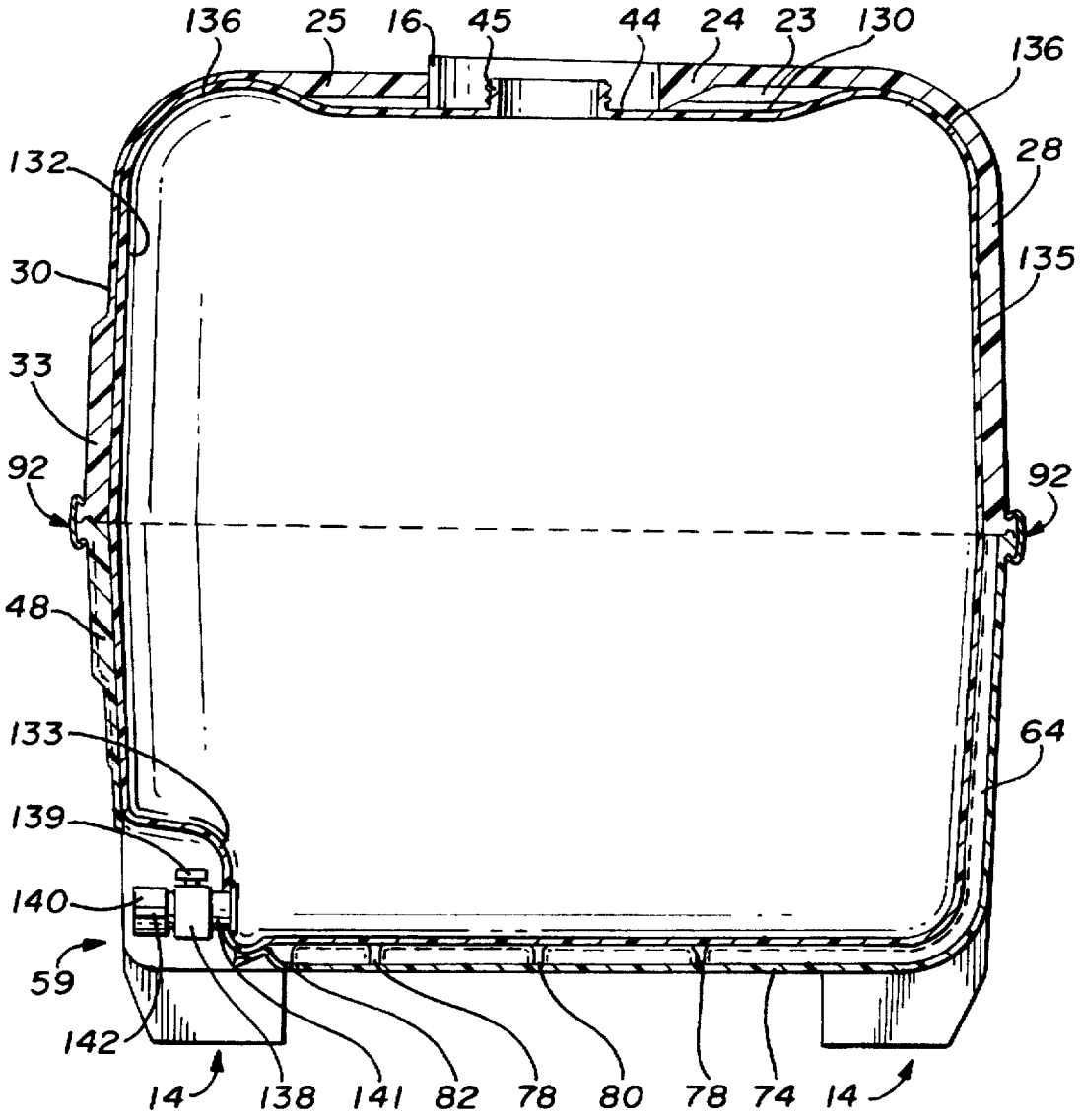
FIG. 31 is a side sectional view of the container with the bottle of FIG. 28 in place.

An analysis of the approximate loading at the area of feet 14 that occurs when a container 10 is dropped is shown in FIG. 27 which is a plot of load measured in pounds, over time, measured in seconds, when a container 10 would be dropped from a height of four feet onto a level surface. After initial impact, stresses would build up until point A is reached at a load of about 18800 pounds after approximately 0.00125 seconds. Were it not for the crushable feet 14, such stresses would go much higher and eventually drop and generally level out at about 16000 pounds for a period of time, all of which would damage bottle 13. However, feet 14 are designed to fail and to absorb much of the energy. As such, upon impact, container 10 will tend to want to go to the left (as viewed in FIG. 18) on bevelled lip 109 and foot 14 will tend to want to move to the right causing the rupture of arcuate tabs 104, 105, 106, 107 and 108 at the predetermined threshold failure level, point A. Then, because of voids in the foot 14, the stresses drop to about 1000 pounds after about 0.0033 seconds, point B, at which time the compression of foam 119 begins to take place.

At this time, point B, impact energy begins to rise again but at a much gentler slope than as seen between time zero and point A as the foam resists compression. Such slope is indicative of the resistance of the foam to compression, that is, the steeper the slope, the more the foam is resistant to compression. One skilled in the art could readily select the desired resistance characteristics of the foam to create the optimum balance between foam compression and the transfer of energy to the container to meet the particular design circumstances.

The foam can only compress and absorb so much energy before it begins to bottom out at point C, approximately 11900 pounds and 0.0153 seconds of elapsed time. At point C, foam 119 is thus compressed to its maximum and at point D (12200 pounds load at 0.01775 seconds) the center of the bottom of container 10, the point of its most concentrated and maximum deflection, has contacted the impact surface. Because the initial impact of the bottom of the container is at the center, and because the loading for this analysis was measured at the area of feet 14, there is little difference in the load at the foot area between points C and D. However, as the remainder of the bottom surface contacts the impact surface, the load again peaks one last time at point E, approximately 16200 pounds after 0.0189 seconds of elapsed time. Thereafter, the load slowly dissipates over time but bottle 13 is not damaged as would have been the case in the absence of feet 14 where a significantly greater initial load would have been experienced and a significantly greater overall load experienced over a longer period of time.

The small peaks and valleys shown between points A–E in FIG. 27 represent miscellaneous load "noise" caused by a variety of interaction that is taking place between the broken pieces of the feet 14 and foam 119 as they are being crushed under the weight of the container. For example, when a particle of the feet breaks, it releases energy and is no longer supporting a load. Thus, there would be a slight downturn or "noise" in the load curve. However, then another particle of the foot or container will start absorbing more energy and a corresponding upturn in the load is observed.

Nevertheless, feet 14 protect bottle 13 from rupture, with the details of bottle 13 now to be described with particular reference to FIGS. 28–31. As previously indicated, bottle 13 is preferably blow molded of a high density polyethylene and while it is formed to take the shape shown in the drawings, as previously described, it is somewhat flexible and will expand somewhat when filled, or may also tend to expand under high temperature and/or pressure conditions or if container 10 is dropped. Such expansion, for example, may be outwardly against and even between ribs 42, 43, 70 and 71 and upwardly against top bottle hold down ribs 23. As such, all surfaces of bottle 13 are fully supported in container 10.

As previously described, the top surface 130 of bottle 13 has a threaded neck 45 defining the bottle opening 131 and adapted to receive cap 18. The front wall 132 is formed with a recess 133 within which valve assembly 59 is carried. Side bottle surfaces 134 and rear bottle surface 135 are rather uniform and uninterrupted, with upper shoulders 136 being formed between side surfaces 134 and top surface 130.

When bottle 13 is positioned in container 10, its valve assembly 59 is exposed as it extends into pocket 58 of front wall 46 of lower section 12. Valve assembly 59 is rather conventional and includes a valve body 138, operating handle 139, and a cap 140 which can be threaded onto and which thereby closes the discharge spout 141 which communicates with the material in bottle 13. Cap 140 may be provided with tabs 142 to assist in its twisting manipulation. Alternatively, instead of threading cap 140 onto spout 141, tabs 142 can be formed as moveable levers and be rotatable in a forward direction, in a cam lock fashion, to lock cap 140 on spout 141 as would be readily apparent to one skilled in the art.

Figure 32:
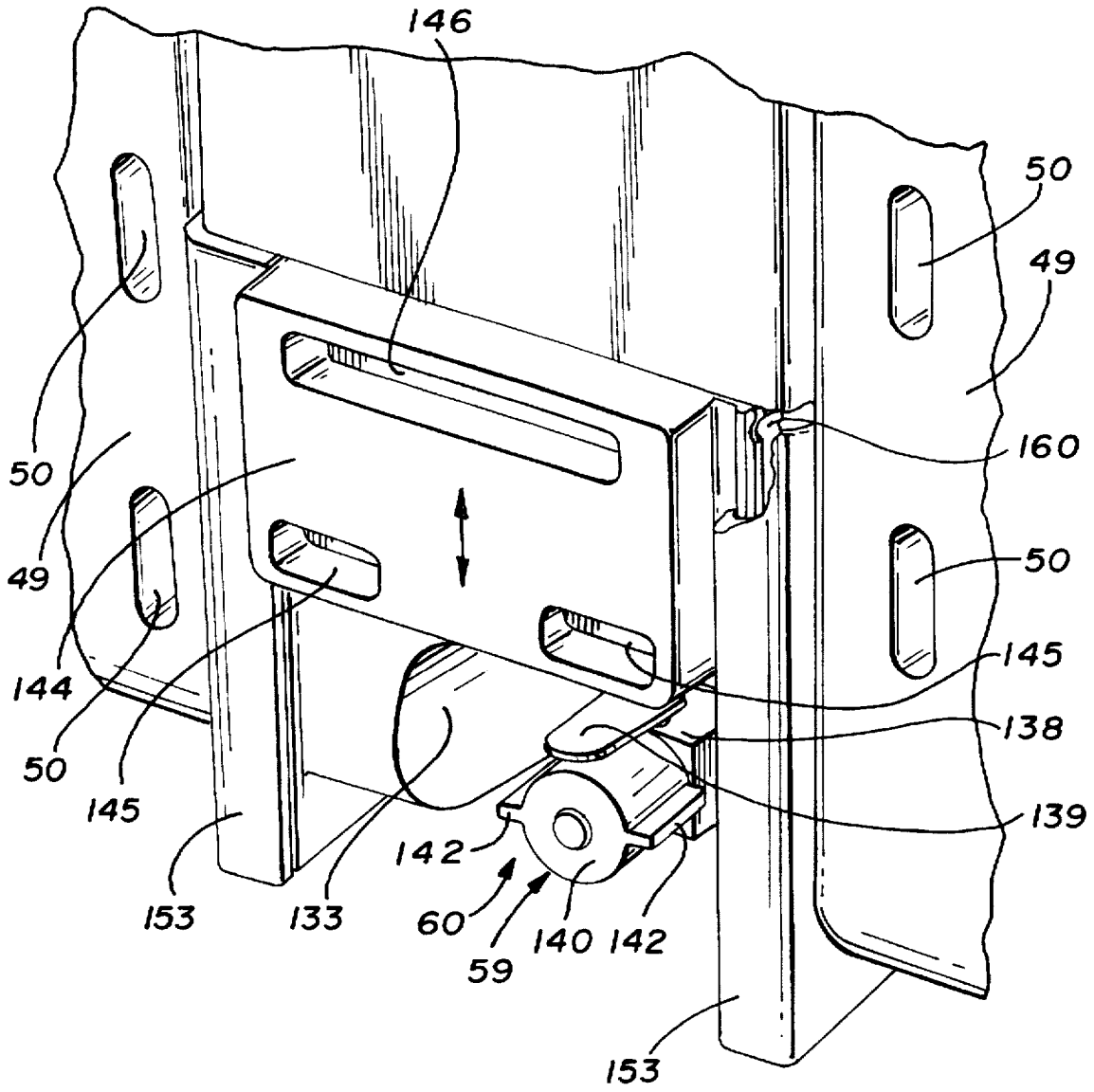
FIG. 32 is a fragmented perspective view of the lower, central, front portion of the lower section of the container showing a closure mechanism for the valve of the bottle.
Figure 33:
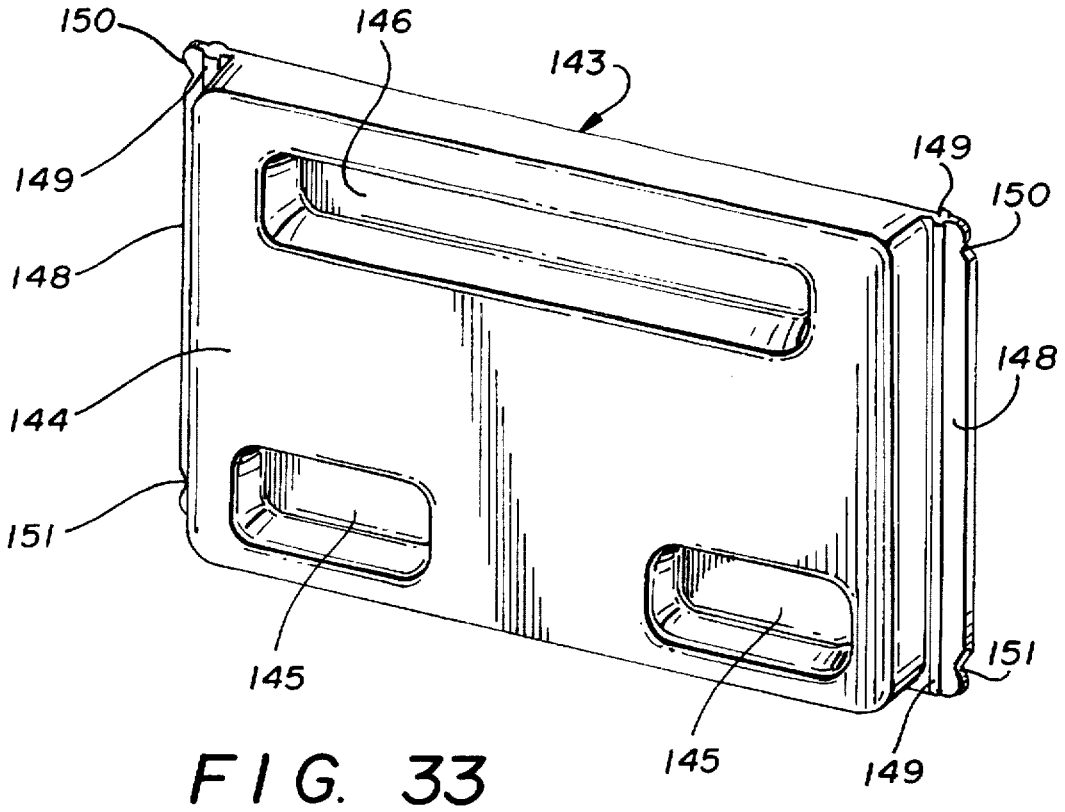
FIG. 33 is a perspective view of the door of the closure mechanism shown in FIG. 32.
Figure 34:
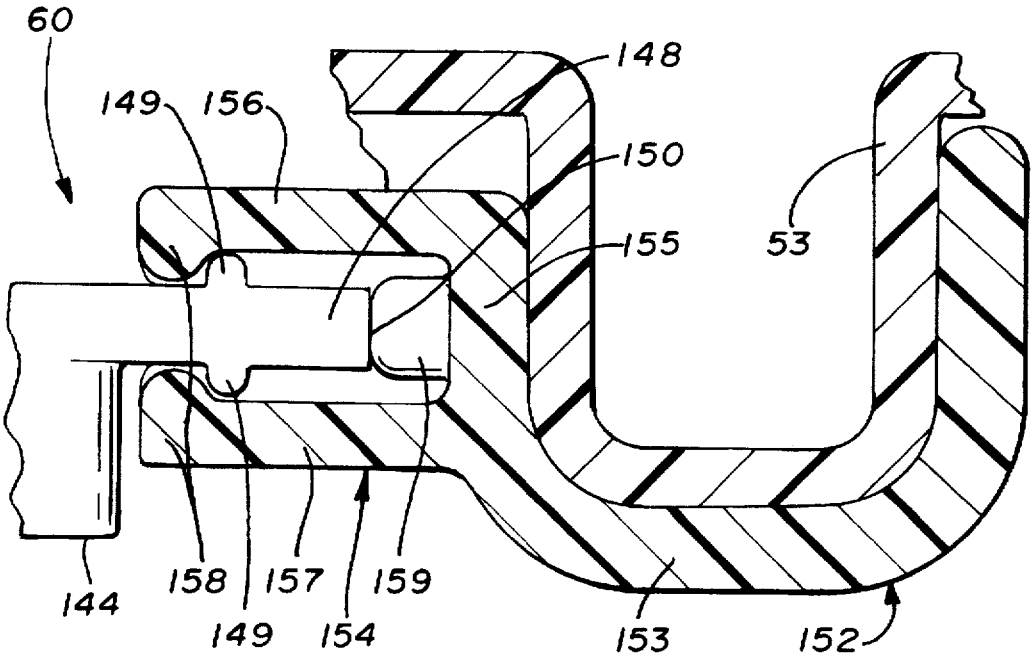
FIG. 34 is a fragmented sectional view taken substantially along line 34—34 of FIG. 1.

Valve access closure mechanism 60 is provided to protect valve assembly 59 when not in use and is shown in detail in FIGS. 32–34. Mechanism 60 includes a door generally indicated by the numeral 143 having a front face 144 with lower grip slots 145 and an upper grip slot 146 formed therethrough. Side flanges 148 extend laterally outward at the rear of door 143 and each flange 148 has a guide rail 149 extending forwardly and rearwardly therefrom. A lock notch 150 is formed near the top of the lateral edge of each flange 148 and another lock notch 151 is formed near the bottom of the lateral edge of each flange 148. Track members, generally indicated by the numeral 152, have a hooked laterally outer end 153 which can be received over and thereby carried by drainage ribs 53 of lower container section 12. A U-shaped track 154, having a base 155 and branches 156 and 157 having one end extending from the ends of base 155, is formed at the laterally inner end of each track member 152. The other end of branches 156 and 157 are provided with opposed nubs 158 which can engage guide rail 149 of door 143 to limit its lateral as well as front to back movement to thereby guide, and prevent any cocking of, door 143. Each base 155 of each track 154 carries a lower lock lug 159 (FIG. 34) and an upper lock lug 160 (FIG. 32) extending outwardly therefrom between branches 156 and 157. Door 143 may be moved up and down relative to track members 152 by grasping slots 145 and/or slot 146, as may be convenient, and is held in the open position as upper lugs 160 snap into upper lock notches 150. When closed, door 143 is held in a stable condition as lower lugs 159 have been snapped into lower lock notches 151.

Based on the foregoing disclosure of the invention, it should be evident that a container 10, constructed as described, accomplishes the objects of the invention and otherwise substantially improves the art.

We claim:

1. A container comprising a first section having a top surface, walls extending downwardly from said top surface, and an open bottom; a second section having a bottom surface, walls extending upwardly from said bottom surface to mate with said walls of said first section, and an open top; and elongate clip members slidable along mating of said walls of said first section and mating of said walls of said second section thereby connecting said mating of said walls of said first section to said mating of said walls of said second section so that said open bottom communicates with said open top to form the container.

2. A container according to claim 1 wherein there is a single clip member for each of said mating walls.

3. A container according to claim 2 further comprising means to attach each said clip member to said first and second sections.

4. A container according to claim 2 further comprising spaced lugs formed near the bottom of said walls of said first section, spaced lugs formed near the top of said walls of said second section and alignable with said spaced lugs of said first section, a notch formed on top of said lugs of said first section, and a notch formed on the bottom of said lugs of said second section, each said clip member having opposed tongs received in said notches.

5. A container according to claim 4 further comprising a tongue on said lugs of one of said sections and a groove on said lugs of the other of said sections, said tongue being received in said groove.

6. A container comprising a first section having a top surface, walls extending downwardly from said top surface, and an open bottom; a second section having a bottom surface, walls extending upwardly from said bottom surface to mate with said walls of said first section, and an open top; means to connect mating of said walls of said first section to mating of said walls of said second section so that said open bottom communicates with said open top to form the container; and a plurality of foot assemblies supporting said bottom surface; each said foot assembly including a hollow foot having a plurality of breakable tab members extending upwardly therefrom, and means to attach at least some of said tab members to said bottom surface so that when a load is applied to the container, said at least some of said tab members will break to absorb the energy of the load.

7. A container according to claim 1 further comprising an internal container supported by said bottom surface and having a valve assembly therein, an opening in one of said walls to provide access to said valve assembly, a door for selectively opening and closing said opening, and means for maintaining said door in an open position.

8. A container according to claim 1 further comprising spaced ribs extending inwardly from said walls, and a flexible internal container supported at least in part by said ribs, said internal container being capable of expanding into the spaces between said ribs.

9. A container according to claim 1 further comprising drainage channels formed on an inside of said bottom surface, and a drain hole in one of said channels, all of said channels being sloped so that any liquid in the container may be directed in said channels to said drain hole.

10. A container according to claim 1 wherein said top surface has corners and is irregularly configured, the container further comprising a plurality of foot assemblies attached to said bottom surface, said foot assemblies having a predetermined profile, and generally flat ledges formed at said corners of said top surface and being generally of the same profile as said predetermined profile so that the container can be stacked on a like container by positioning said foot assemblies of the container on the ledges of the like container.

11. A container according to claim 1 further comprising corner columns formed between each of said walls of said first section and corner columns formed between each of said walls of said second section, said corner columns of said first section mating with the corner columns of said second section to provide structural strength to the container.

12. A container comprising a bottom surface; walls extending upwardly from said bottom surface; and a plurality of foot assemblies supporting said bottom surface and said walls; each said foot assembly including a hollow foot having a plurality of breakable tab members extending upwardly therefrom, a crushable foam block in said hollow foot, and means to attach at least some of said tab members to said bottom surface so that when a load is applied to the container, said at least some of said tab members will break and said foam block will crush to absorb the energy of the load.

13. A container according to claim 12 further comprising a plurality of rib members extending downwardly from said bottom surface and positioned adjacent to said tab members, said means to attach including fasteners extending through selected of said tab members and selected of said rib members.

14. A container according to claim 12, each said foot assembly further including a second plurality of tab members extending upwardly from said foot, said second plurality of tab members being shorter than said plurality of tab members, said foam block extending to a point higher than said second plurality of tab members but lower than said plurality of tab members.

15. A container according to claim 14, each said foot assembly further including means to attach at least some of said second plurality of tab members to said bottom surface.

16. A container according to claim 12, each said foot assembly further including an upper arcuate ledge carrying said plurality of tab members, said bottom surface having a plurality of rib members extending downwardly therefrom and adjacent to said tab members.

17. A container according to claim 16, each said foot assembly further including a bevelled lip on said ledge, said rib members resting on said bevelled lip.

18. A container according to claim 16, each said foot assembly further including lower linear ledges and a second plurality of tab members extending upwardly from said lower linear ledges, said bottom surface having a second plurality of rib members extending downwardly therefrom to rest on said lower linear ledges adjacent to said second plurality of tab members.

19. A container according to claim 12 further comprising an internal container supported by said bottom surface and having a valve assembly therein, an opening in one of said walls to provide access to said valve assembly, a door for selectively opening and closing said opening, and means for maintaining said door in an open position.

20. A container according to claim 12 further comprising spaced ribs extending inwardly from said walls, and a flexible internal container supported at least in part by said ribs, said internal container being capable of expanding into the spaces between said ribs.

21. A container according to claim 12 further comprising drainage channels formed on an inside of said bottom surface, and a drain hole in one of said channels, all of said channels being sloped so that any liquid in the container may be directed in said channels to said drain hole.

22. A container according to claim 12 wherein said walls form an open top and further comprising an irregularly configured top surface having corners and closing said open top formed by said walls, said foot assemblies having a predetermined profile, and generally flat ledges formed at the corners of said top surface and being generally of the same profile as said predetermined profile so that the container can be stacked on a like container by positioning said foot assemblies of the container on the ledges of the like container.

23. A container according to claim 12 further comprising corner columns formed between each of said walls to provide structural strength to the container.

24. A container comprising a bottom surface, walls extending upwardly from said bottom surface, an internal container supported by at least said bottom surface and having a valve assembly therein which is located between said walls thereby being within the container, an opening in one of said walls to provide access to said valve assembly, a door freely movable for selectively opening and fully closing said opening without engaging said valve assembly so that said valve assembly is not exposed, means for maintaining said door in an open position, and separate means for maintaining said door in a fully closed position.

25. A container according to claim 24 further comprising vertical track members positioned along the sides of said opening and carried by said one of said walls, said door having side flanges, each including a rail riding within said track members.

26. A container according to claim 25 wherein said means for maintaining said door in an open position includes a notch formed near the top of each said flange and a lug formed on each said track member to engage said notch to maintain said door open.

27. A container according to claim 26 wherein said separate means for maintaining said door in a fully closed position includes a second notch formed near the bottom of each said flange, and a second lug engaging said second notch to maintain said door in the fully closed position.

28. A container according to claim 24 further comprising at least one hand grip slot in said door.

29. A container according to claim 24 further comprising spaced ribs extending inwardly from said walls and supporting said internal container, said internal container being flexible so that it may expand into the spaces between said ribs.

30. A container according to claim 24 further comprising drainage channels formed on the inside of said bottom surface, and a drain hole in one of said channels, all of said channels being sloped so that any liquid in the container may be directed in said channels to said drain hole.

31. A container according to claim 24 further comprising an irregularly shaped top surface connecting the tops of said walls, a plurality of foot assemblies attached to said bottom surface and having a predetermined profile, and generally flat ledges formed at the corners of said top surface and being generally of the same profile as said predetermined profile so that the container can be stacked on a like container by positioning said foot assemblies of the container on the ledges of the like container.

32. A container according to claim 24 further comprising corner columns formed between each of said walls to provide structural strength to the container.

33. A container comprising a top surface, walls having one end extending downwardly from said top surface, a bottom surface joining the other end of said walls to form the enclosed container, spaced ribs extending inwardly from said walls, an expandable internal container supported at least in part by said ribs, and spaced ribs extending downwardly from said top surface to hold down said internal container as it may want to expand such that upon impact of the container said internal container is capable of expanding into the spaces between said ribs of said walls and capable of expanding into the spaces between said ribs of said top surface to prevent rupture of said internal container.

34. A container comprising a bottom surface; walls extending upwardly from said bottom surface; and a plurality of foot assemblies supporting said bottom surface and said walls; each said foot assembly including a hollow foot having a plurality of breakable tab members extending upwardly therefrom, and means to attach at least some of said tab members to said bottom surface so that when a predetermined load is applied to the container, said at least some of said tab members will break to absorb at least a portion of the energy of the load.

35. A container according to claim 33, said internal container being translucent, and further comprising sight-holes in said walls so that the amount of contents in said internal container may be identified.

36. A container comprising a top surface, walls having one end extending downwardly from said top surface, a bottom surface joining the other end of said walls to form the enclosed container, spaced ribs extending inwardly from said walls, a flexible internal container supported at least in part by said ribs, said internal container being capable of expanding into the spaces between said ribs, and arcuate surfaces formed in said top surface and spaced ribs formed within said arcuate surfaces, said internal container being capable of expansion into the space formed between said spaced ribs in said arcuate surfaces.

37. A container according to claim 36 wherein said arcuate surfaces and said spaced ribs formed within said arcuate surfaces extend partially down said walls.

38. A container according to claim 33 further comprising drainage channels formed on an inside of said bottom surface, and a drain hole in one of said channels, all of said channels being sloped so that any liquid in the container may be directed in said channels to said drain hole.

39. A container according to claim 33 wherein said top surface has corners and is irregularly configured, the container further comprising a plurality of foot assemblies attached to said bottom surface, said foot assemblies and having a predetermined profile, and generally flat ledges formed at said corners of said top surface and being generally of the same profile as said predetermined profile so that the container can be stacked on a like container by positioning said foot assemblies of the container on the ledges of the like container.

40. A container according to claim 33 further comprising corner columns formed between each of said walls to provide structural strength to the container.

41. A container comprising a top surface, walls having one end extending downwardly from said top surface, a bottom surface joining the other end of said walls to form the enclosed container, drainage channels formed on an inside of said bottom surface, and a drain hole in one of said channels, all of said channels being sloped so that any liquid in the container may be directed in said channels to said drain hole.

42. A container according to claim 41 wherein there are drainage channels running between each of said walls, and further comprising vertical drainage channels formed in each of said walls communicating with said drainage channels running between each of said walls so that liquid in said vertical drainage channels may be directed to said drain hole.

43. A container according to claim 41 wherein said top surface has corners and is irregularly configured, the container further comprising a plurality of foot assemblies attached to said bottom surface, said foot assemblies and having a predetermined profile, and generally flat ledges formed at said corners of said top surface and being generally of the same profile as said predetermined profile so that the container can be stacked on a like container by positioning said foot assemblies of the container on the ledges of the like container.

44. A container according to claim 41 further comprising corner columns formed between each of said walls to provide structural strength to the container.

45. A container comprising an irregularly configured top surface, walls having one end extending downwardly from said top surface, a bottom surface joining the other end of said walls to form the enclosed container, a plurality of foot assemblies attached to said bottom surface and having a predetermined profile, and generally flat ledges formed at the corners of said top surface and being of generally the same profile as said predetermined profile so that when the container is stacked on a like container by positioning said foot assemblies of the container on the ledges of the like container, said same profile of said flat ledges is in full contact with said predetermined profile of said foot assemblies.

46. A container according to claim 45 wherein said profile is pie shaped having an arcuate outer surface and two linear outer surfaces.

47. A container according to claim 46 further comprising a lip extending upwardly from said arcuate surface of each said ledge to laterally confine the like container on the container.

48. A container according to claim 45 further comprising corner columns formed between each of said walls to provide structural strength to the container.

49. A container according to claim 48 wherein said corner columns are positioned below said ledges to assist in supporting the like container.

50. A container comprising a top surface, walls having one end extending downwardly from said top surface, a bottom surface joining the other end of said walls to form the enclosed container, corner columns formed between each wall to provide structural strength to the container, a bottle carried within the container and isolated from said corner columns, and a foot assembly carried beneath each corner column, each said foot assembly including means to intentionally permit the failure thereof upon impact, such that upon impact each said foot assembly will fail to absorb some of the energy of the impact, said corner columns absorbing other energy of the impact to protect said bottle from rupture.

51. A container according to claim 50 wherein said walls are recessed within said corner columns so as to protect said walls from damage.

52. A container according to claim 50 further comprising an upper section including said top surface and a portion of said walls and said corner columns, a mating lower section including said bottom surface and a portion of said walls and said corner columns, and means to attach said upper section to said lower section, said means also adding hoop strength to the container.

53. A container according to claim 52 further comprising mating arcuate skirts on said corner columns of said upper section and said lower section, said arcuate skirts extending outwardly to protect said means to attach which is recessed therebetween.

54. A container according to claim 50 further comprising ribs on said top surface, said walls, and said bottom surface to, with said corner columns, provide structural strength to the container.

55. A container comprising a first section having an irregularly configured top surface, walls extending downwardly from said top surface, and an open bottom; a second section having a bottom surface, walls extending upwardly from said bottom surface to mate with said walls of said first section, and an open top; means to connect mating of said walls of said first section to mating of said walls of said second section so that said open bottom communicates with said open top; corner columns formed between each said wall of said first section and each said wall of said second section; spaced ribs extending inwardly from each said wall of said first section and each said wall of said second section;

a flexible internal container supported at least in part by said bottom surface and said ribs, said internal container being capable of expanding into the spaces between said ribs and having a valve assembly therein; an opening in one of said walls of said second section to provide access to said valve assembly; a door for selectively opening and closing said opening; means for maintaining said door in an open position; drainage channels formed on an inside of said bottom surface; a drain hole in one of said channels, all of said channels being sloped so that any liquid in the container may be directed in said channels to said drain hole; a plurality of foot assemblies supporting said bottom surface; each said foot assembly including a hollow foot of a predetermined profile and having a plurality of breakable tab members extending upwardly therefrom, a crushable foam block in said hollow foot, and means to attach at least some of said tab members to said bottom surface so that when a load is applied to the container, said at least some of said tab members will break and said foam block will crush to absorb the energy of the load; and generally flat ledges formed on said top surface and being of generally the same profile as said predetermined profile of each said foot so that the container can be stacked on a like container by positioning each said foot of the container on the ledges of the like container.

* * * * *